US005113742A

United States Patent [19]

Matsumoto

[11] Patent Number: 5,113,742

[45] Date of Patent: May 19, 1992

[54] ELECTRONIC STRINGED INSTRUMENT

[75] Inventor: Naoaki Matsumoto, Tokyo, Japan

[73] Assignee: Casio Computer Co., Ltd., Tokyo, Japan

[21] Appl. No.: 668,968

[22] Filed: Mar. 13, 1991

Related U.S. Application Data

[62] Division of Ser. No. 464,430, Jan. 12, 1990, which is a division of Ser. No. 171,883, Mar. 21, 1988, Pat. No. 4,919,031.

[30] Foreign Application Priority Data

| | | | |
|---|---|---|---|
| Mar. 24, 1987 | [JP] | Japan | 62-67919 |
| Mar. 24, 1987 | [JP] | Japan | 62-67920 |
| Mar. 30, 1987 | [JP] | Japan | 62-47616[U] |
| Mar. 30, 1987 | [JP] | Japan | 62-47617[U] |
| Mar. 30, 1987 | [JP] | Japan | 62-47618[U] |
| Mar. 30, 1987 | [JP] | Japan | 62-47619[U] |
| Mar. 30, 1987 | [JP] | Japan | 62-77257 |
| May 27, 1987 | [JP] | Japan | 62-80659[U] |
| May 27, 1987 | [JP] | Japan | 62-80660[U] |

[51] Int. Cl.[5] ..... G10H 7/00

[52] U.S. Cl. ..... 84/615; 84/600; 84/622; 84/626; 84/646

[58] Field of Search ..... 84/600, 615, 616, 622, 84/626, 627, 644, 645, 646, 653, 654, 658, 659, 670

[56] References Cited

U.S. PATENT DOCUMENTS

| | | |
|---|---|---|
| 3,073,203 | 1/1973 | Evans . |
| 3,731,022 | 5/1973 | Loftus . |
| 4,062,263 | 12/1977 | Yamaga et al. . |
| 4,080,867 | 3/1978 | Ratanangsu . |
| 4,117,757 | 10/1978 | Akamatu . |
| 4,151,775 | 5/1979 | Merriman . |
| 4,171,475 | 10/1979 | Erickson . |
| 4,235,141 | 11/1980 | Eventoff . |
| 4,263,520 | 4/1981 | Kajihata et al. . |
| 4,286,495 | 9/1981 | Roof . |
| 4,300,431 | 11/1981 | DeRocco . |
| 4,321,852 | 3/1982 | Young, Jr. . |
| 4,326,442 | 4/1982 | Suzuki . |
| 4,336,734 | 6/1982 | Polson . |
| 4,357,852 | 11/1982 | Suenaga . |
| 4,372,187 | 2/1983 | Berg . |
| 4,468,997 | 9/1984 | Young . |
| 4,606,255 | 8/1986 | Hayashi et al. . |

(List continued on next page.)

FOREIGN PATENT DOCUMENTS

| | | |
|---|---|---|
| 2014865 | 10/1978 | Fed. Rep. of Germany . |
| 54-161924 | 12/1979 | Japan . |
| 55-152597 | 11/1980 | Japan . |
| 57-54994 | 4/1982 | Japan . |
| 57-37074 | 8/1982 | Japan . |
| 57-58672 | 12/1982 | Japan . |
| 61-26090 | 2/1986 | Japan . |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

When picking of a string is performed, the vibration of the string is detected accurately and quickly. When a fret operation position is changed during generation of a musical tone caused by the string picking, the pitch of the musical tone is changed to the one corresponding to the new fret operation position without generating a new musical tone. When the same string is stroked successively, the succeeding musical tone is generated while keeping the reverberation of the previous musical tone. The musical tone once generated will be stopped from being generated upon elapse of a predetermined time from the beginning of the tone generation, irrespective of the type of its timbre. When a fret operation state is changed to an open-string operation state after the string picking, the generation of the musical tone being generated stops at that timing. When this change occurs, it is selectable whether the generation of the musical tone is to be stopped or its pitch is to be changed to the one corresponding to the open-string operation state. The generation musical tone can freely be stopped from being generated through a manual operation.

6 Claims, 23 Drawing Sheets

U.S. PATENT DOCUMENTS 4,627,323 12/1986 Gold .
4,630,520 12/1986 Bonanno .
4,653,376 3/1987 Allured et al. .
4,657,114 4/1987 Shaw .
4,658,690 4/1987 Aitken et al. .
4,677,419 6/1987 Meno .
4,688,460 8/1987 McCoy .
4,719,834 1/1987 Hall et al. .
4,723,468 2/1988 Takabayashi et al. .
4,726,275 2/1988 Aitken et al. .
4,748,887 6/1988 Marshall .
4,760,767 8/1988 Tsurubuchi .
4,794,838 1/1989 Corrigan .
4,817,484 4/1989 Iba et al. .
4,827,824 5/1989 Minakuchi .
4,919,031 4/1990 Matsumoto .

FIG. 6a
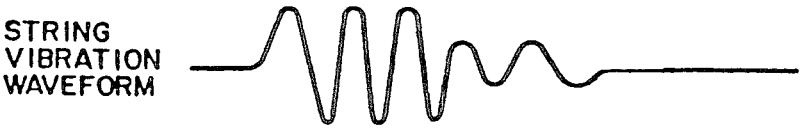
FIG. 6b
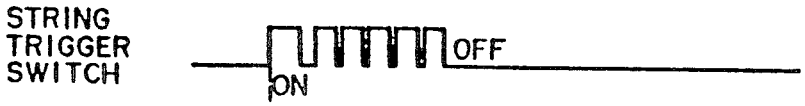
FIG. 6c
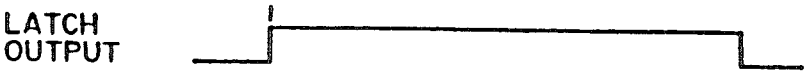
FIG. 6d
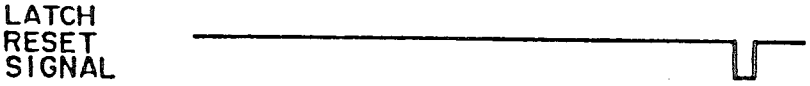
FIG. 7a
FIG. 7b
FIG. 7c
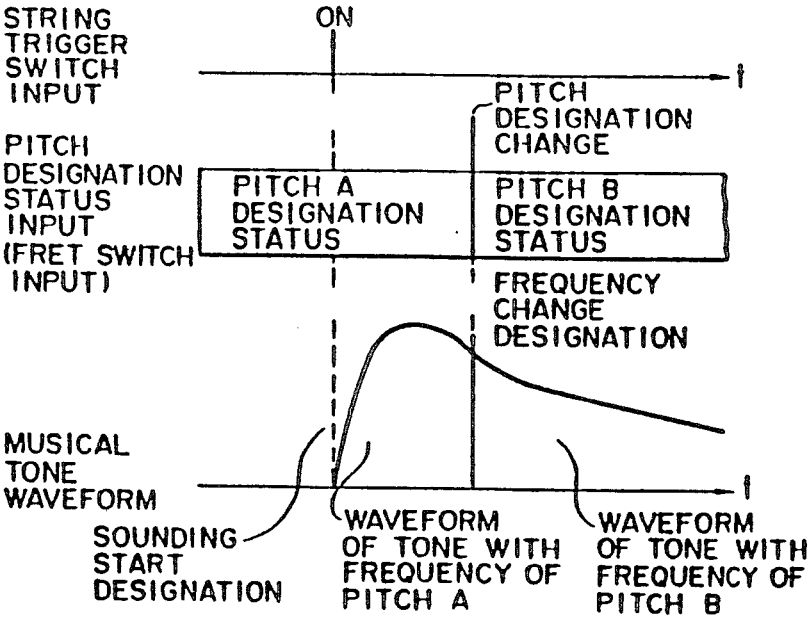

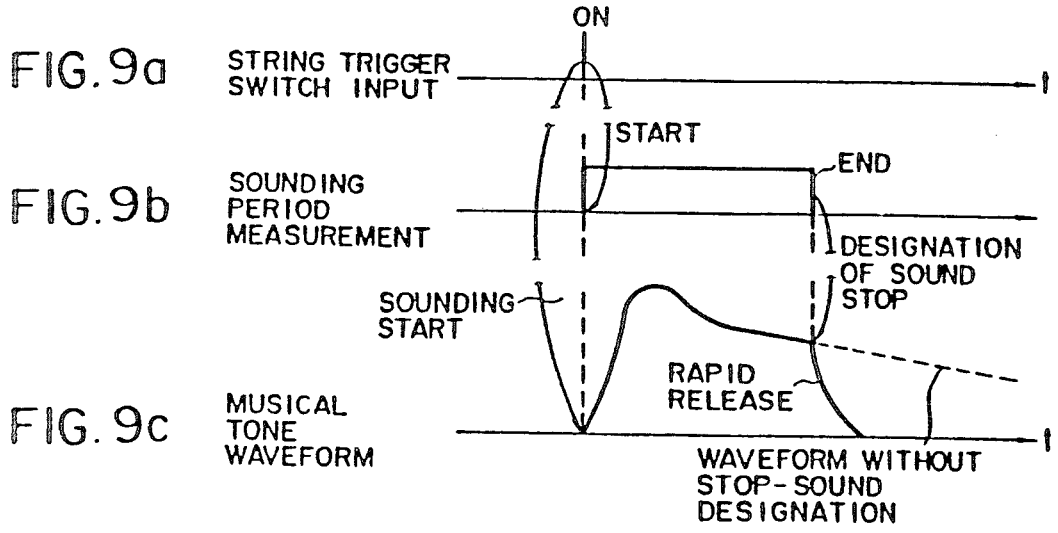
FIG. 9a
STRING TRIGGER SWITCH INPUT
ON
FIG. 9b
SOUNDING PERIOD MEASUREMENT
START
END
DESIGNATION OF SOUND STOP
FIG. 9c
MUSICAL TONE WAVEFORM
SOUNDING START
RAPID RELEASE
WAVEFORM WITHOUT STOP-SOUND DESIGNATION

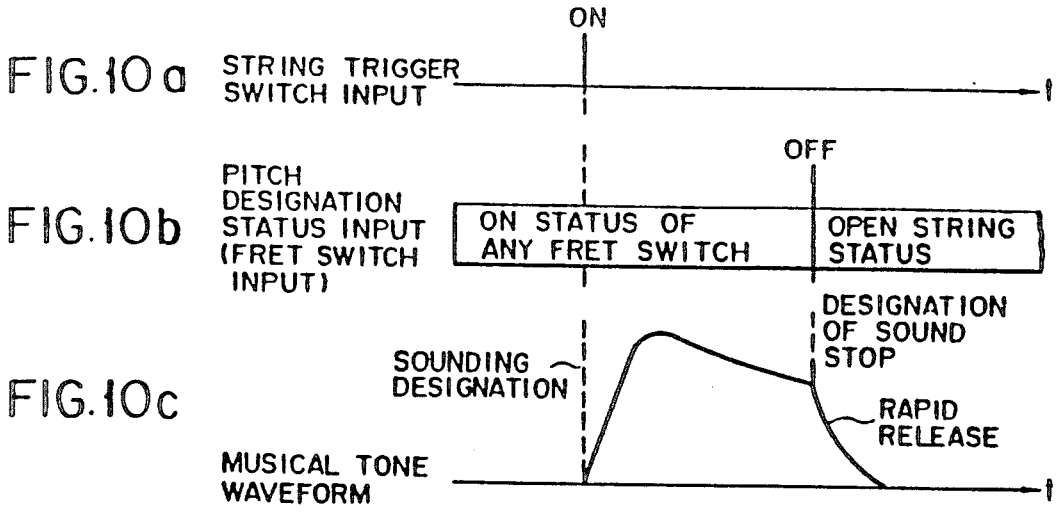
FIG. 10a
STRING TRIGGER SWITCH INPUT
ON
FIG. 10b
PITCH DESIGNATION STATUS INPUT (FRET SWITCH INPUT)
OFF
ON STATUS OF ANY FRET SWITCH
OPEN STRING STATUS
FIG. 10c
SOUNDING DESIGNATION
DESIGNATION OF SOUND STOP
RAPID RELEASE
MUSICAL TONE WAVEFORM

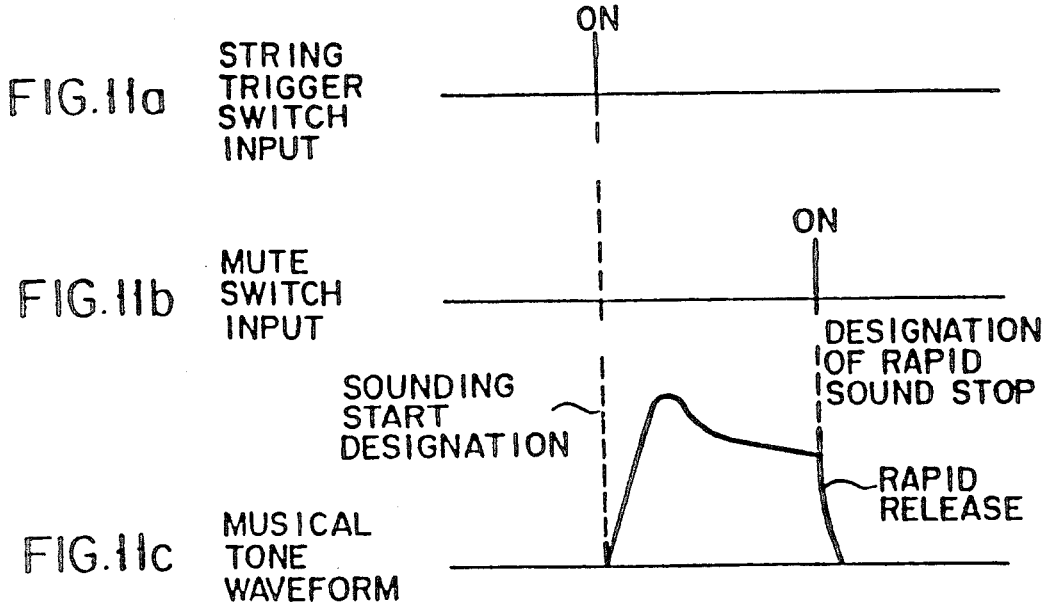
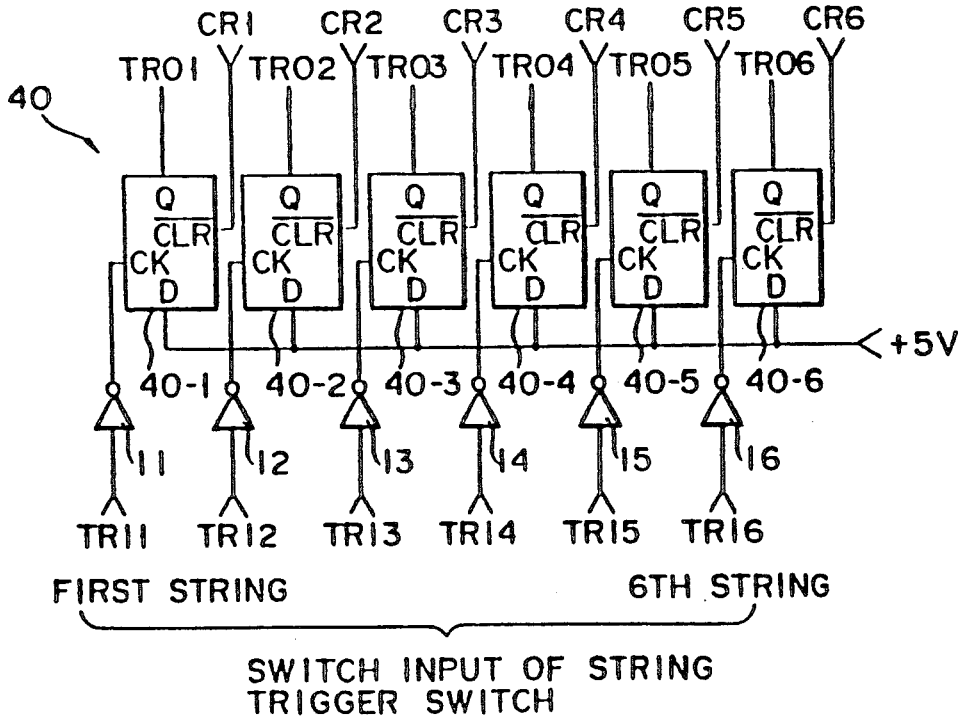
FIG. 12

ELECTRONIC STRINGED INSTRUMENT

This is a division of application Ser. No. 07/464,430 filed Jan. 12, 1990, which is a division of Ser. No. 07/171,883 now U.S. Pat. No 4,919,031.

BACKGROUND OF THE INVENTION

1. Field of the Invention

The present invention relates to an electronic stringed instrument, and, in particular, to an electronic stringed instrument which can generate musical tones with multifarious timbres, when played in the same typical manner as is done with traditional natural stringed instruments, such as stroking, picking and fingering stretched strings.

2. Description of the Related Art

Recently, with rapid improvement of electronic technology, electronic stringed instruments have been developed and proposed, which can generate musical tones with multifarious timbres by the same picking technique as is done with traditional natural stringed instruments. Electronic stringed instruments of this type are classified into a pitch extracting type and a string triggering type from the view points of the method to designate a musical tone to be generated and the method to generate the musical tone with a specified pitch.

According to the pitch extracting type electronic stringed instruments, the vibration frequency of a stretched string or the pitch is extracted from the vibration caused by picking the string, and the pitch of the corresponding musical tone is determined on the basis of the extracted pitch, and the musical tone with a given timbre is generated at the determined pitch when the level of the string vibration becomes greater than a predetermined value.

According to the string triggering type electronic stringed instruments, the operation position of a fret presently depressed is detected by a pitch designation operation status sensor provided on a fingerboard side, the pitch of the corresponding musical tone is designated by the sensor, the picking operation status with respect to a string is detected by a string triggering sensor provided on a body side, and a musical tone with a given timbre is generated by the string triggering sensor at the pitch designated by the former pitch designation operation status sensor. For this type of electronic stringed instruments, there are various types of pitch designation operation status sensors for detecting the fret operation position to designate the pitch of a musical tone to be generated. For instance, the following types are known:

1) The type which has a number of ON/OFF type fret switches disposed in a matrix form in the fingerboard.

2) The tablet coordinate detecting type.

3) The type which has a resistance member for each string whose resistance is detected.

4) The type which detects a string-depressed position from electric contact between a conductive string supplied with a small current and a fret contact.

5) The type which detects the pitch by supplying an ultrasonic wave in strings and measuring the return time of the wave from a string-depressed position.

Also, there are various types of string triggering sensors for detecting the beginning of the string vibration and designating the beginning of tone generation. They include:

1) The magnetic pickup detecting type which magnetically detects the vibration of stretched strings.

2) The type which detects the axial directional vibration of a string using a Hall element and a magnet.

3) The string triggering switch type which is actuated by the vibration of a string to detect the beginning of the string vibration.

4) The piezo-electric element detecting type which detects the string vibration using a piezoelectric element.

5) The light pickup type which detects the string vibration from the light shielding state.

The advantage of the string triggering type electric stringed instruments over the pitch extracting type lies in their simpler structure such that the beginning of the string vibration is detected by the string triggering sensor, a musical tone is generated in response to the detection, and the pitch of the musical tone to be generated is determined by a pitch designation signal from pitch designation operation status detecting means.

On the other hand, the string triggering type has such a prominent shortcoming that musical tones generated by operating strings do not have rich musical effects or impressions. Electronic stringed instruments, as they are indeed stringed instruments, should be able to provide as rich musical impression as can be produced by traditional stringed instruments, and this is one of the important indices to be good stringed instruments. To get the index, A) Electronic stringed instruments should be playable in a manner very similar to the one involved in traditional stringed instruments, such as guitars, and should well respond to natural operation.

B) The electronic stringed instruments should produce the same acoustic or musical effects as can be obtained by the traditional type when played in the same manner.

However, electronic stringed instruments which can sufficiently fullfil the above requirement are not yet available because there still are various problems that should be solved. These problems will be explained below.

According to conventional, string triggering type electronic stringed instruments, even when a fret operation position is changed during generation of an musical tone associated with a triggered string, its sound source does not respond to the change so that the frequency of the musical tone cannot be changed to the pitch corresponding to the new fret position. In other words, the conventional electronic stringed instruments have a limited function to permit generation of a single musical tone for one picking action. This significantly restricts the playing modes to such a level that the allowable playing modes or techniques, and hence the resultant musical effects, can be in no way matched with those of acoustic or electric guitars.

As a solution to this problem, some of the techniques used in keyboard type electronic instruments may be applied to the electronic stringed instruments, so that every time the fret operation position is changed, the generation of a musical tone being generated can be stopped and a new musical tone can be generated at the pitch corresponding to the new fret operation position.

With the use of such a tone generating method, however, when a string is picked with the right hand and the fret operation is done by sliding the left hand along the string during tone generation caused by the picking, a new musical tone will be generated every time the fret operation position is changed Therefore, if, for example, the sliding (sliding the left hand along a string) is executed, the electronic stringed instruments cannot provide a effect similar to the sliding sound effect (only the pitch varying from one pitch to another) which can be produced from acoustic guitars by the sliding operation.

According to conventional stringed instruments using a string triggering switch, with respect to a string vibration above a given level, the switch temporarily becomes the ON state, which does not continue; the switch functions in a specific correlation with the string vibration. For instance, the string triggering switch does not respond to a very weak string vibration and repeatedly becomes the alternate ON/OFF state when a large vibration continues.

Therefore, when the output of the string triggering switch is directly sampled by a processor such as a microcomputer, the transition between the ON and OFF states of the switch due to the string vibration cannot be always accurately detected For instance, at the beginning of the string vibration, even when the string triggering switch temporarily becomes the ON state, it is possible that the processor does not perform the sampling during the ON duration. At the worst, picking of a string is not detected by the processor. If not the worst, the processor may detect the picking with such a delay from the operational timing of the string that adverse musical effects are produced.

It is desirable that the beginning of tone generation coincide with the string operation timing or the beginning of the string vibration.

The above problem can be solved to some degree by sufficiently shortening the interval between samplings by the processor. This increases the burden of the processor with respect to an input device, thus requiring a simpler and assured detection of the string triggering (beginning of the string vibration).

To realize an electronic stringed instrument having a plurality of strings, the relationship between the strings and sound sources (which electronically generate musical tones) should be considered.

As one approach, one sound source may be assigned to a single string. Assume that this system is applied to the above string triggering switch type electronic string instruments. Then, when the switch detects the triggering of one string, the processor assigns one of plural sound sources to the string and instructs the sound source to start generating a musical tone at a pitch corresponding to the fret operation position, which is detected by the fret status detecting means. Consequently, the musical tone is generated from the sound source. When the same string is triggered again and the triggering is detected by the switch during generation of the musical tone from that sound source, the processor instructs the sound source to stop the tone generation and, upon completion of the tone stopping, instructs the sound source to generate the musical tone. However, the pitch for the second tone generation corresponds to the fret operation position detected by the fret status detecting means at that time. In other words, in this example, when the same string is triggered successively, the succeeding sound is generated after the previous sound is stopped.

The above approach cannot regrettably simulate the function of the sound box of a natural stringed instrument such as an acoustic guitar. According to the stringed instrument with the sound box, when the same string is successively picked, the generation of the second musical tone starts while the reverberation of the first musical tone continues. Such reverberation effect is as important property of this type of natural stringed instruments and gives a good musical impression to a listener. This desirable reverberation effect cannot be expected from the aforementioned electronic stringed instruments.

Further, according to the conventional electronic stringed instruments, the sound source selects a pitch signal from the fret switch only when supplied simply with a string triggering signal. The waveform signal with the frequency corresponding to the pitch signal is formed by a VCO element of the sound source. Meanwhile, an envelope circuit of the sound source is driven by the string triggering signal and its mode sequentially changes from attack to decay, release, etc. The waveform signal of the above frequency is controlled by the output of the envelope circuit to provide a musical tone signal. Therefore, the continuous tone-generation time (time from the beginning of the tone generation until the end of the tone generation) is determined by the length of an envelope.

One of the functions of a synthesizer is to generate a musical tone with a number of timbres. Adding such a function to electronic stringed instruments raises problems which would not be caused in the case of electronic keyboard instruments.

One of the problems is concerned with the sound stopping control with respect to musical tones with timbres of the sustain tone system, such as an organ. The envelope for typical timbres of the sustain tone system includes a step called sustain. The sustain step has a fixed envelope value so that the musical tones of the sustain tone system are kept generated unless a sound stop instruction is sent to an envelope generator from the processor, etc. In many electronic keyboard instruments, when a key is released, a key-off signal is generated and sent to the processor, which in turn instructs the envelope generator to stop the tone generation. For instance, in an organ-sound mode, an organ sound is kept generated during depression of a key, but it is released to be stopped when the key is released.

It is regrettable that the key-off operation is not involved in traditional stringed instruments. Stringed instruments such as guitars significantly differ from keyboard instruments such as pianos and organs in mechanics and playing modes As one simple approach to allow the key-off operation in electronic stringed instruments, they may be designed to have a guitar-like outline but have a keyboard added to provide a key-off signal when operated. Such instruments cannot, however, be called guitars any longer and lose the natural properties of stringed instruments such as guitars. Electronic stringed instruments, as the name stands for, should have a similarity with traditional stringed instruments at least on the basic level.

According to traditional natural stringed instruments, with a string depressed by a finger of one hand, for example, the left hand, the string is stroked or picked by the right hand, causing the string vibration which generates its associated musical tone. When the finger is moved off the string, the string vibration is rapidly reduced, thus rapidly releasing the musical tone being generated One approach to realize this phenomenon in electronic stringed instruments is to permit the instruments to electronically detect the end of the string vibration. This approach is, however, difficult to realize as it needs a string vibration sensor for accurately detecting the string vibration and some means for analyzing in real time the output of the sensor and accurately detecting the real end of the vibration while removing a spurious component included in the sensor output (for example, a phenomenon which appears as if the vibration is temporarily stopped). If realized, however, the manufacturing cost would be significantly high.

As already described earlier, with the structure of the conventional electronic stringed instruments, it is not possible to simulate the musical effect (varying only the pitch without regeneration of a new musical tone) produced by, for example, the sliding, one of guitar's basic playing techniques, according to which the fret operation position is sequentially shifted with a finger or fingers of the left hand after a string is picked by the right hand. (First simulation subject)

In acoustic guitars or the like, in addition to the sliding, a plurality of strings are generally used to play a melody. In this case, while one fret of one string is depressed with a finger of the left hand, the string is picked by the right hand, and then the finger of the left hand is moved to another string and the new string is picked by the right hand, and so forth. In the process of moving the finger of the left hand from one string to another, that finger should naturally be moved off the first string and the first string goes to the so-called open-string status. This transition to the open-string status often reduces the string vibration and this phenomenon is aurally sensed as the stopping of a sound. That is, when a finger is moved from one string to another to play a melody, the open-string pitch of the first string is not prominently audible.

Therefore, to electronically simulate such a basic phenomenon is the second simulation subject.

There still exists a difficult problem in the above case. The transition to the open-string status does not always reduce the string vibration to such a level that the phenomenon is sensed as sound stopping. For instance, when the fret status is changed from the first fret to the open-string status, it is likely that the pitch of the open string is heard following the pitch of the first fret. (If, after moving the finger of the left hand off the string, the same string is again depressed (sound stop fingering) or the string is lightly touched with a finger of the right hand, the string vibration is absorbed by the finger, so that the phenomenon can be sensed as the sound stopping.) In short, the first simulation subject contradicts the second simulation subject.

One solution to this contradiction may be to provide the electronic stringed instruments with an ability to convert the string vibration into an electric signal with a high fidelity and electrically follow up the behavior of the real string vibration in real time while removing various spurious or noise components which may be included in the converted output, whereby a sound source is properly controlled. However, this approach is difficult to realize at present, and if realized, the products would certainly be very expensive.

Natural stringed instruments such as acoustic guitars can be played distinguishing how much the string vibration should be attenuated or whether the vibration of only one string or the vibration of all the strings should be stopped, etc., by the way strings are operated with fingers of the right or left hand (for example, touching a vibrating string with a finger or a palm). It is, however, extremely difficult to electronically perform the complete simulation of the above. Even if a sensor for converting the string vibration into an electronic signal with a relatively high fidelity, an analyzing device for analyzing the output of the sensor needs to be provided with an ability to accurately follow up in real time the behavior of the string vibration, which should finally be reflected on a musical tone, while eliminating the influence of various spurious components included in the string vibration itself (signal source itself), whereby the mode of attenuating the string vibration can be distinguished, for example, through pattern matching. If the above function is realized somehow, the final products would be very expensive.

Conventionally, electronic stringed instruments have been known, which has a foot-operable fast decay pedal mounted outside the instrument main body whereby generation of a musical tone being generated can be rapidly be stopped by operating the fast decay pedal with a foot, as disclosed in U.S. Pat. No. 4,336,734.

Since, in the above electronic stringed instruments, rapid stopping of the tone generation should be executed by operating the fast decay pedal disposed at a player's foot, the instruments can only be played where the fast decay pedal is disposed. This restriction does not permit the player to play the electronic stringed instruments while moving around.

SUMMARY OF THE INVENTION

The present invention has been devised to solve the aforementioned various conventional problems and its objects are as follows.

It is an object of this invention to provide an electronic stringed instrument, which can accurately and quickly detect the vibration of a string caused by picking the string, with a simple structure.

It is another object of this invention to provide an electronic stringed instrument which, when the fret operation position is changed during generation of a given musical tone caused by picking a string, can change the pitch of the generated musical tone to the pitch corresponding to the new fret operation position without generating a new musical tone.

It is a still another object of this invention to provide an electronic stringed instrument which, when the same string is stroked successively in a short period of time, can generate a succeeding musical tone while reverberation of the previously-generated musical tone continues, thus providing a sufficient tone reverberation effect.

It is a further object of this invention to provide an electronic stringed instrument which can stop generation of a musical tone immediately upon elapse of a predetermined time from the beginning of the tone generation, irrespective of whether the generated musical tone is of a sustain tone system or a release tone system.

It is a still further object of this invention to provide an electronic stringed instrument which, when the fret operation status is changed to an open-string operation status after picking of a string, can stop all the presently-generated musical tones or that musical tone whose associated string is changed to the open-string operation status.

It is a still further object of this invention to provide an electronic stringed instrument which, when a given fret operation status is changed to an open-string operation status, can determine whether the presently-generated musical tone is to be rapidly released from the timing at which the transition to the open-string operation status is made or the pitch of the musical tone is to be changed to the one corresponding to the open-string operation status from the above timing, in accordance with the intention of a player.

It is a still further object of this invention to provide an electronic stringed instrument which can freely stop all or a part of the presently-generated musical tones at an arbitrary timing with a simple manual operation by a player while the player, moving around, is playing the instrument.

BRIEF DESCRIPTION OF THE DRAWINGS

FIGS. 6*a*-6*d* are diagrams for explaining a string triggering detecting function;

FIGS. 7*a*-7*c* are diagrams for explaining a pitch change function;

FIGS. 9*a*-9*c* are diagrams for explaining a sound stop function executed upon elapse of a sounding time of a musical tone;

FIGS. 10*a*-10*c* are diagrams for explaining a sound stop function executed when the transition to an open-string operation status is made;

FIGS. 11*a*-11*c* are diagrams for explaining a tone muting function;

FIG. 12 is a diagram illustrating the structure of a latch circuit;

DETAILED DESCRIPTION OF THE PREFERRED EMBODIMENT

An embodiment of this invention will now be explained with reference to the accompanying drawings.

[Instrument Main Body (FIG. 1)]

Figure 1:
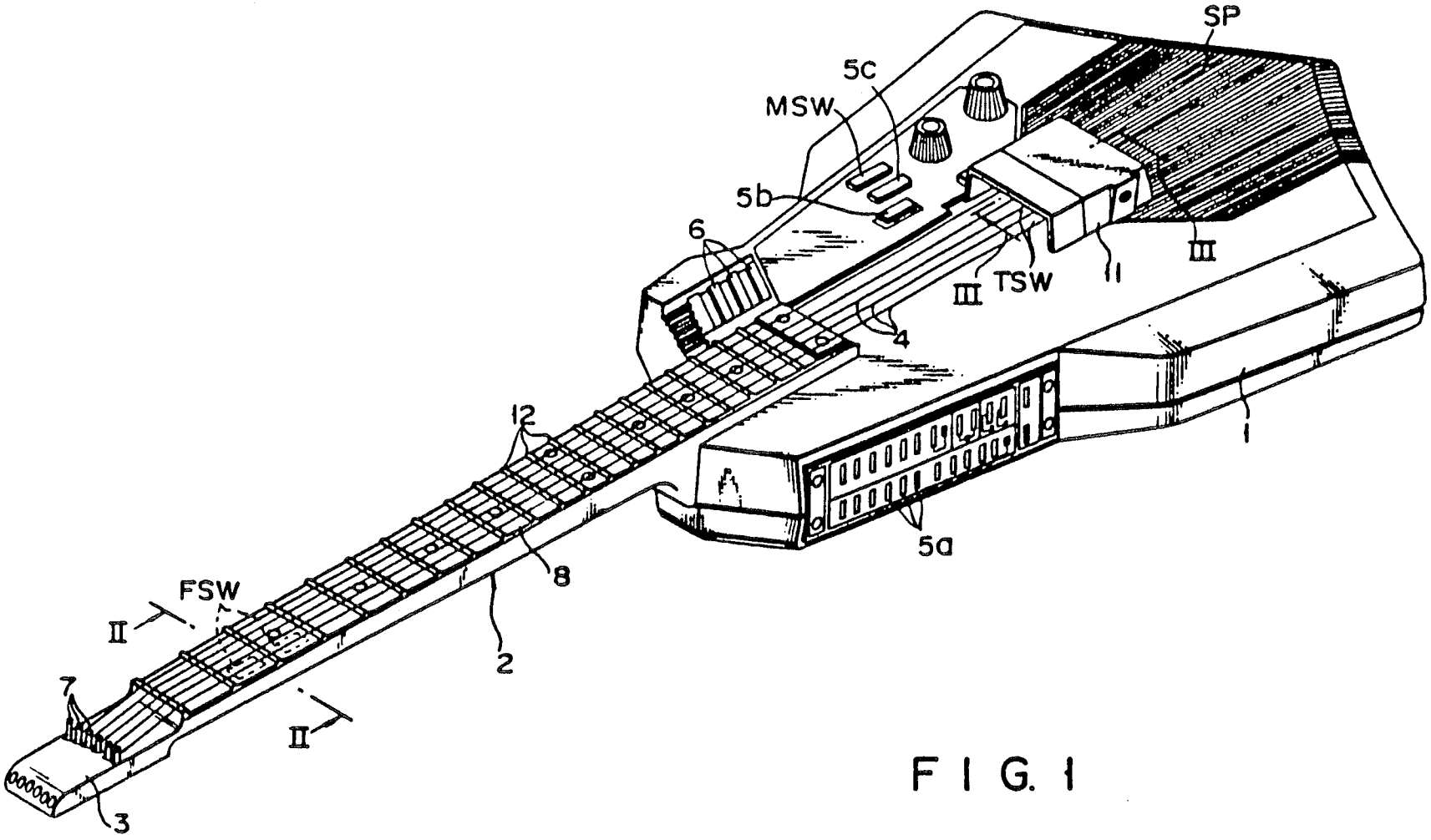
FIG. 1 is an overall perspective view of an electronic stringed instrument according to one embodiment of this invention.

FIG. 1 shows the main body of an electronic stringed instrument according to this embodiment. As illustrated, the main body of the stringed instrument has a body 1, a neck 2 and a head 3, with a plurality of strings 4 stretched along the length of the main body. Body 1 has parameter setting switches 5 for setting various parameters. The switches 5 include timbre select switches 5*a*, a mute switch 5*b*, a string release mode select switch 5*c* and a mute reserve switch MSW. Also, rhythm pad switches 6 are provided as operation elements for manual rhythm performance. Inside body 1 is a speaker disposed to generate played musical tones.

Each string 4 has one end adjustably supported by its associated peg 7 provided on head 3, and has the other end extending on a fingerboard 8 to a string trigger switch case 11 disposed on a rear portion of body 1 and fixed in the case 11. On fingerboard 8 are fret switches FSW provided in a matrix form for pitch designation; when strings 4 between frets 12 are depressed, the associated fret switches FSW are turned on. A detailed description of the fret switches FSW will be given later.

Case 11 accommodates string trigger switches TSW, which are coupled to the associated strings 4 in such a manner that picking or fingering strings 4 turns the associated string trigger switches TSW on, thereby starting the sounding of the musical tones. A detailed description of the string trigger switches TSW will be given later.

[Fret Switches (FIG. 2)]

Figure 2:
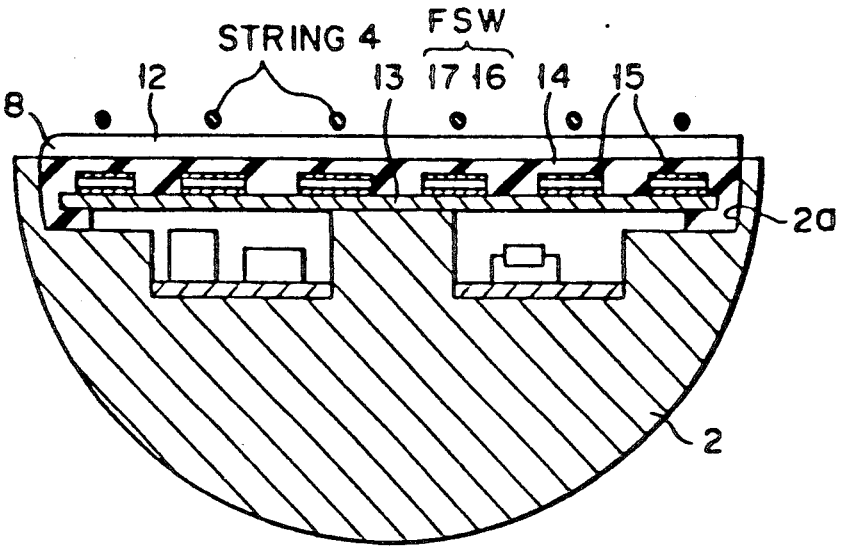
FIG. 2 is a cross-sectional view taken along line II—II of FIG. 1.

FIG. 2 exemplifies the structure of fret switches FSW. As illustrated, a printed board 13 and a rubber sheet 14 are fit and fixed in a recessed section 2*a* formed in the top of neck 2. Rubber sheet 14 is adhered on printed board 13 and has its either end bent in a U shape to accommodate the associated end of printed board 13 so that the board 13 is fixed. Six rows of contact recesses 15 are formed along the length of neck 2 at locations corresponding to the individual strings 4 at the bottom of rubber sheet 14, which is adhered to the top of printed board 13. A pattern of electrodes 16 serving as movable contacts is formed on the bottom surfaces of recesses 15, and a pattern of electrodes 17 serving as stationary contacts is formed on printed board 13, the electrodes 17 facing the associated electrodes 16. Each electrode 17 and its associated electrode 16 constitute a fret switch FSW. When strings 4 on fingerboard 8 are depressed rubber sheet 14, hence depressing rubber sheet 14, electrodes 16 are made to have an electric contact with electrodes 17 so that fret switches FSW are turned on.

[String Trigger Switches (FIG. 3)]

Figure 3:
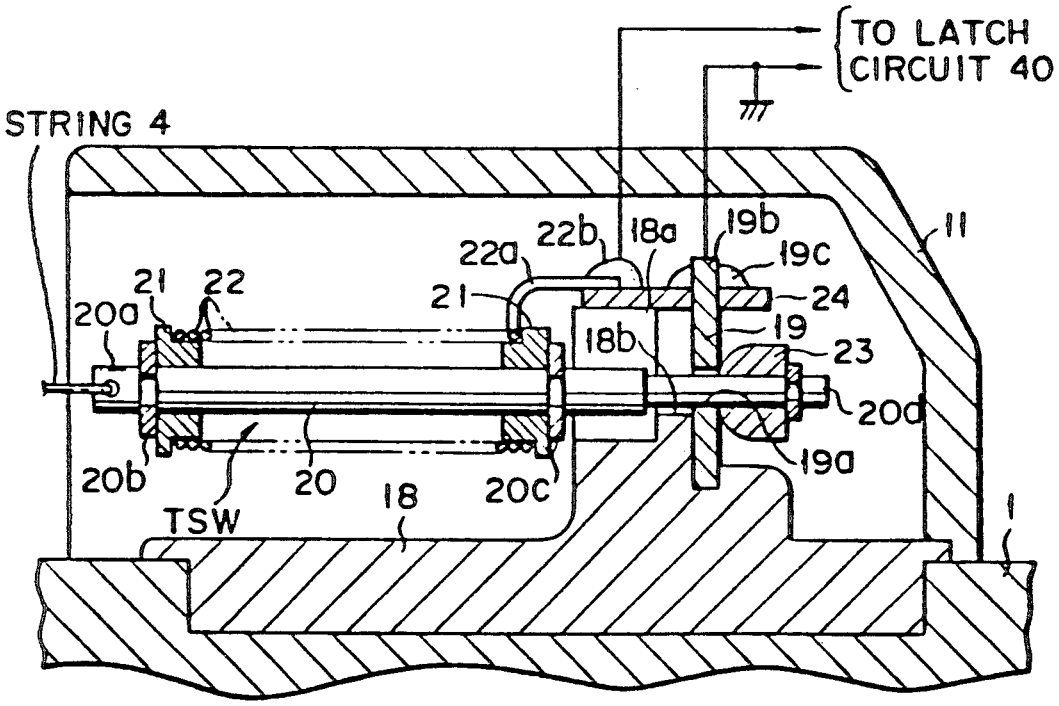
FIG. 3 is a cross-section view taken along line III—III of FIG. 1.

FIG. 3 exemplifies the structure of string trigger switches TSW. As mentioned earlier, string trigger switches TSW are turned on or off by strings 4 on body 1. As illustrated in FIG. 3, on body 1 is disposed a switch mounting table 18, which has a projecting section and a support section 18*a* provided on the upper portion of the projection section. In support section 18*a* are grooves 18*b* formed whose number corresponds to the number of strings 4. A metal contact plate 19 is attached to the rear edge portion of support section 18*a*, and has through holes 19*a* formed therein at positions corresponding to the individual strings 4. Conductive members 20 integrally coupled to the respective strings 4 are fit in the associated through holes 19*a*. Each conductive member 20 is a circular metal rod with a predetermined length and has an engage hole 20*a* at its distal end where the associated string 4 is engaged Each conductive member 20 further has a first stop ring 20*b* provided at the rear portion of the engage hole 20*a* and a second stop ring 20*c* separated by a predetermined distance from the former ring 20*b*. The first and second stop rings 20*b* and 20*c* are provided to prevent a pair of insulative members 21, provided on the associated conductive member 20 with a predetermined interval therebetween, from moving in the lengthwise direction of conductive member 20. Both insulative members 21 and 21 have stepped portions facing each other, and a spring coil 22 serving as a flexible conductive member is bridged between the two stepped portions. Each conductive member 20 has a support shaft 20*d* formed at that portion thereof which extends from the back of second stop ring 20*c* and is narrower than the remaining portion. The end portion of support shaft 20*d* is fit in the associated groove 18*b* of support section 18*a* and the associated through hole 19*a* of contact plate 19, and is engaged with a stopper 23 having a semi-sphere distal end portion, in a slidable manner around the through hole 19*a*. That is, each conductive member 20 has its rear end slidably engaged with support shaft 20*d* and the other, free end supported to be stretched by its associated string 4. Projecting pieces 19*b*, formed at the top portion of contact plate 19 in correspondence with through holes 19*a*, are fixedly fit in predetermined locations of a printed board 24 provided on support section 18*a* and are coupled to a wiring pattern formed on printed board 24, by means of solder 19*c*. A lead wire 22*a* extending from one end of each coil spring 22 coupled through insulative members 21 to conductive member 20 is also coupled to another wiring pattern formed on printed board 24, by means of solder 22*b*.

The illustrated trigger switches TSW, described above, each have conductive member 20 as the first contact and coil spring 22 as the second contact. In normal state, a space corresponding to the thickness of insulative member 21 is kept between coil spring 22 and conductive member 20. When a vibration of a certain degree or more is caused by operating string 4, however, coil spring 22 vibrates due to the vibration. As a result, the space between conductive member 20 and coil spring 22 varies with time and the member 20 and spring 22 repeat contact and non-contact states. In other words, trigger switch TSW is repeatedly turned on and off. As will be described later, according to this embodiment, the status change of this trigger switch TSW toward the first ON state (i.e., triggering of string 4) can be assuredly detected.

[Overall Circuit Arrangement (FIG. 4)]

Figure 4:
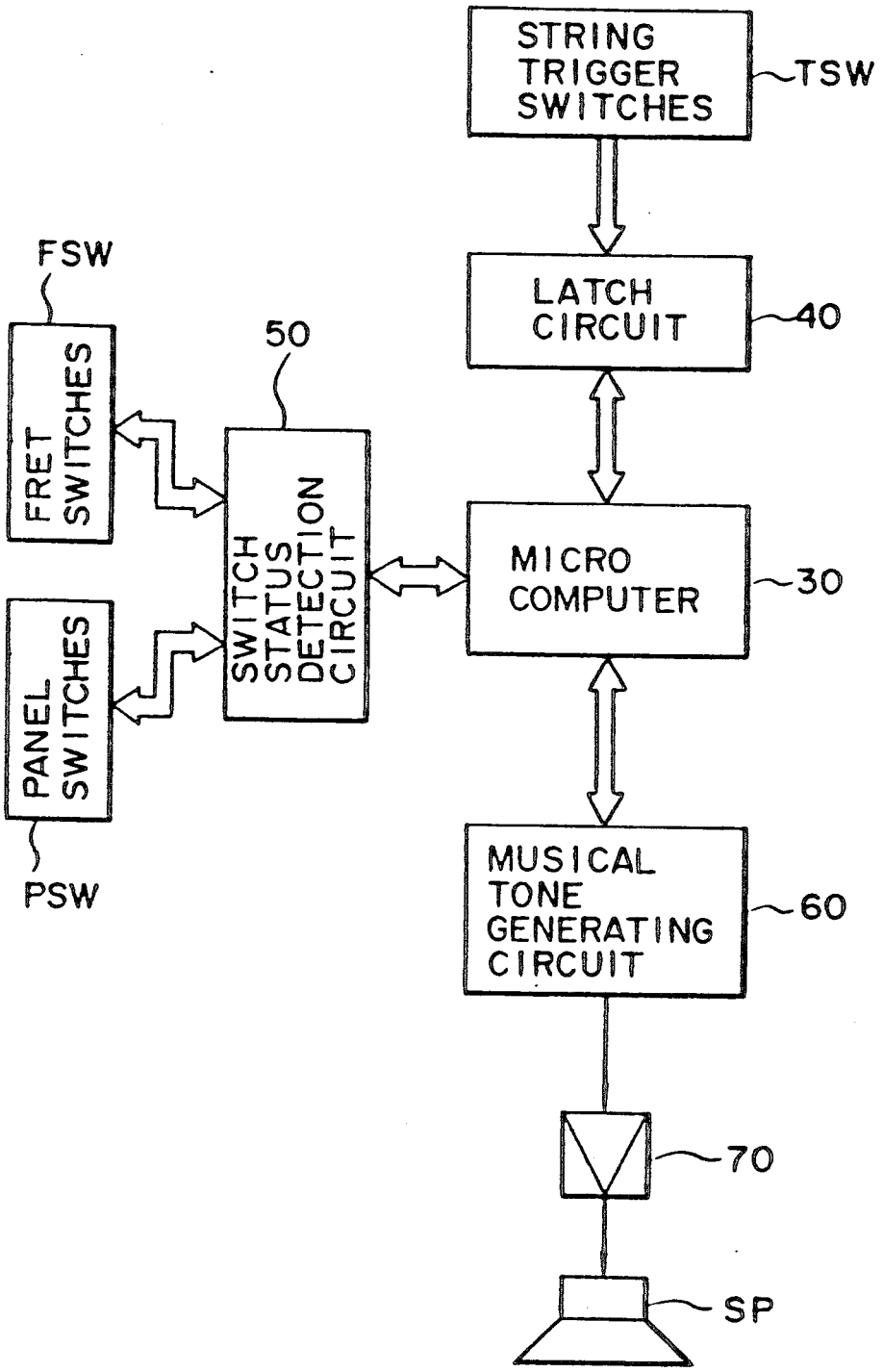
FIG. 4 is an overall diagram of an electronic circuit used in this invention.

FIG. 4 illustrates the overall circuit arrangement of an electronic stringed instrument according to this embodiment. The general control of the instrument is performed by a microcomputer 30. The outputs of trigger switches TSW are supplied to a latch circuit 40 and microcomputer 30 detects the triggering of strings 4 through this latch circuit 40. The status of each fret switch FSW and the status of each of panel switches PSW (various switches provided on body 1, such as parameter setting switches 5 and rhythm pad switches 6, as shown in FIG. 1) are reported to microcomputer 30 through a switch status detection circuit 50. A musical tone generating circuit 60 generates a musical tone signal under the control of microcomputer 30. The generated tone signal is amplified in an amplifier 70 and is output as a sound through a speaker SP.

[General Flow of Microcomputer (FIG. 5)]

Figure 5:
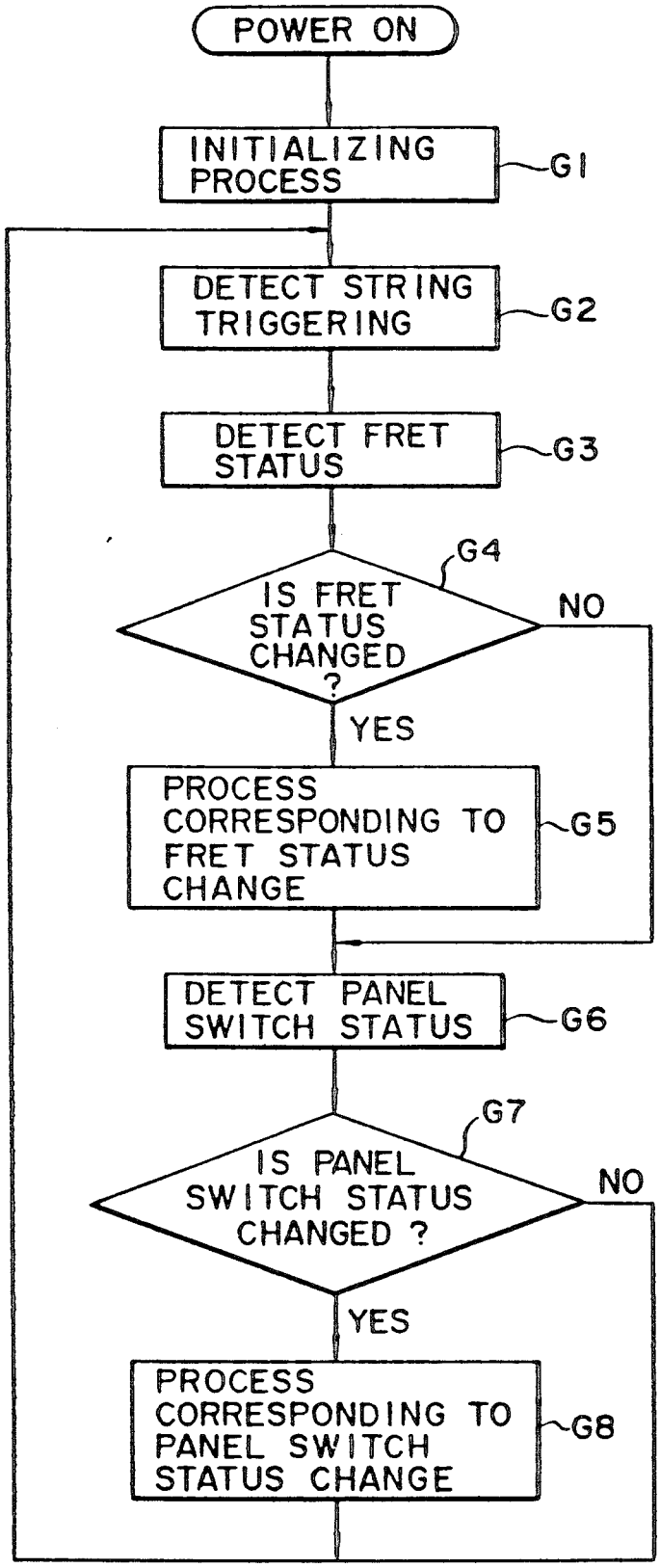
FIG. 5 is a general flowchart of this invention.

FIG. 5 illustrates the general flow of microcomputer 30 (see FIG. 4). When the instrument is powered up, microcomputer 30 executes initializing step G1 first, and then repeats steps G2 through G8. In string triggering detection step G2, microcomputer 30 reads the output of latch circuit 40 (FIG. 4) and determines whether or not there is the triggering of each string 4. When the string triggering (start of vibration of the strings) is detected, microcomputer 30 causes musical tone generating circuit 60 to generate a musical tone. In fret status detection step G3, microcomputer 30 reads the status of each fret switch FSW through switch status detection circuit 50. Then, a change in fret status (change in pitch designation) is determined in fret status change discrimination step G4, and if the change exists, fret status change step G5 is performed. If the string-depressing position of a fret belonging to that string which is presently producing musical sounds is changed, the pitch of the string is set again to the pitch corresponding to the change (this process being performed with respect to that sound source module in musical tone generating circuit 60 which is producing the musical sound of the string) in step G5. If the fret status is changed to a so-called open string status where any fret switch FSW belonging to the sound-producing string is at the OFF state, a sound stop operation is performed. No process is done with respect to a change, if any, in the string-depressing position of frets belonging to those strings which are presently producing no sounds. In the next panel switch status detection step G6, microcomputer 30 reads out the status of each panel switch PSW through switch status detection circuit 50. In panel switch status change discrimination step G7, a change in status of a panel switch is discriminated, and if the decision is affirmative, a desired process, for example, setting the timbre, effect or the like to musical tone generating circuit 60 is performed in the subsequent panel switch status change step G8.

[Features of the Embodiment]

Before going into the detailed descriptions of the individual features, several features of the embodiment will now be given briefly The first feature is an assured detection of string triggering, whose principle is illustrated in terms of waveforms in FIGS. 6*a*–6*d*. FIG. 6*a* illustrates a model vibration waveform of strings 4, and FIG. 6*b* illustrates the status of string trigger switches TSW with respect to this string vibration. As should be clear from comparison between these two waveforms, string trigger switches TSW are repeating the ON and OFF states in accordance with the vibration. When the vibration of strings 4 is reduced by a certain degree or more, string trigger switches TSW are rendered inactive and become the OFF state. Simple sampling of the outputs of such string trigger switches TSW cannot ensure assured and accurate detection of the start of the string vibration or the string triggering.

According to this embodiment, therefore, as indicated by the latch output shown in FIG. 6*c*, a change in the status of string trigger switches TSW to the first ON state is held by the latch circuit and the content of this latch circuit is sampled by microcomputer 30, thereby detecting the string triggering. Further, upon elapse of a predetermined time after the detection, microcomputer 30 supplies a latch reset signal as shown in FIG. 6*d* to the latch circuit to reset it.

The second feature is to change only the pitch in the case where the fret operating position is changed to another position during the sounding of a musical tone. The principle of this feature is illustrated in FIGS. 7*a*–7*c*. Assume that stroking any string is done, the associated string trigger switch is turned on and the triggering of that string is detected, as indicated in FIG. 7*a*. Upon detection of the ON state of the string trigger switch, sounding of a musical tone starts. At this time, the fret operating position of the triggered string is checked in order to determine the pitch of the musical tone to be sounded. Here, the fret status detection means or fret switch FSW for detecting the fret operating position of the triggered string is indicating the status for designating pitch A, as shown in FIG. 7*b*. Consequently, the start of sounding a musical tone with pitch A as the musical tone of the triggered string is designated with respect to a sound source (not shown) and a musical tone waveform having a frequency of pitch A is generated in the sound source, as shown in FIG. 7*c*.

Assume now that, while the musical tone of the triggered string is being generated, another fret position belonging to this string is depressed so that the pitch designation status is changed to the one which designates pitch B, as indicated in FIG. 7*b*. In response to this change, musical tone generating means controls the sound source to change the pitch to pitch B without stopping the sounding of the presently-generated musical tone of the triggered string. As a result, as shown in FIG. 7*c*, simply a musical tone waveform whose frequency is changed to correspond with pitch B is generated from the sound source, not a new musical tone.

As described above, according to this invention, the sounding of a musical tone of a stroked string, once started, is not stopped by a succeeding change in fret operating position, nor is the sounding of a new musical tone started by the change in fret operating position. Only, the frequency or the pitch of the generated musical tone is changed in accordance with the change in fret operating position. Therefore, it is possible to play a gentle phrase which does not have any attack except the one caused at the start of the sound generation by a picking action, so that the same musical effect as attained by a typical guitar can be produced by the same playing procedure as involved in playing such a guitar.

The "pitch designation change" shown in FIG. 7*b* may apply not only to the case of a physical change from one fret position to another, but also to the case where the so-called open-string status (which is used to indicate what the term "open string" normally means with respect to a guitar) is changed to the fret-depressed status at which a fret is depressed, and vice versa. In this case, fret status detection means is designed to be able to detect the open-string status at which no physical fret positions belonging to a triggered string are depressed. And, this design can be easily realized The envelope characteristic of the musical tone waveform (indicated by the envelope) hardly varies before and after the frequency change, thus causing an entirely gentle pitch change. If desired, however, the envelope of the musical tone after the frequency change may be caused to have a slight attack, or the envelope of the musical tone before the frequency change may be caused to slightly fall and the envelope after the change may be caused to rise to the original level.

Figures 8A, 8B:
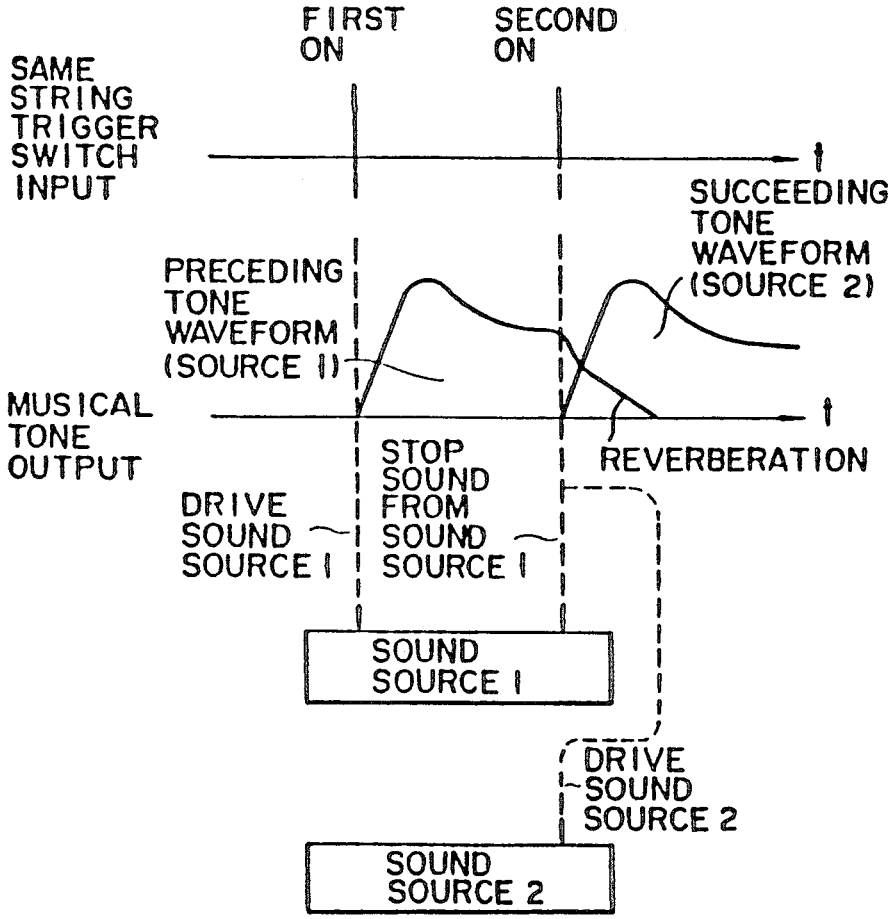
FIGS. 8*a* and 8*b* are diagrams for explaining a tone reverberation function.

The third feature is the function of reverberation of a musical tone generated by successively picking the same string 4 in a short period of time. This function is realized by a different sound source assign/sounding function performed by microcomputer 30. FIG. 8*a* and 8*b* illustrate the principle of the reverberation function.

Assume that the first triggering of one string 4 is detected by the turning on of a string trigger switch TSW, as shown in FIG. 8*a*. In response to the detected status, microcomputer 30 finds out a sound source to generate the intended sound and requests the found sound source (source 1 in this case) to start generating the sound. As a result, sound source 1 produces the first musical tone waveform (the left one) shown in FIG. 8*b* and the generation of the musical tone corresponding to the triggered string 4 starts. Assume now that the same string 4 is stroked again during generation of the musical tone corresponding to that string 4 (see the second ON point in FIG. 8*a*). In response to the retriggering of the same string, microcomputer 30 requests that sound source 1, which is generating the previous musical tone, should stop the generation of the musical tone, and at the same time assigns a sound source 2 different from sound source 1 to generate a musical tone corresponding to the retriggered string. As a result, after the retriggering action, while the previous musical tone being presently generated by sound source 1 is released by the source 1, the succeeding musical tone is generated by sound source 2 and its waveform starts rising (see FIG. 8*b*). This provides an effect similar to the reverberation effect which can be produced by a sound box of an acoustic guitar, etc.

The fourth feature is a sound stop function performed on the basis of the elapse of a sounding time. Specifically, in response to the picking operation of a string, microcomputer 30 measures a predetermined time from the start of the sounding operation and executes the sound stop operation upon elapse of the predetermined time. The principle of this function will be explained below referring to FIG. 9*a*–9*c*. When a string 4 is triggered as shown in FIG. 9*a* and the triggering is detected, microcomputer 30 request a sound source (one of sound source modules in musical note generating circuit 60) to start generating a sound (which has already been described earlier). At the same time, microcomputer 30 starts measuring the time the sound source is generating the sound. Consequently, a musical tone is generated by the sound source as shown in FIG. 9*c*. In this, even when measuring the sound generating time indicated in FIG. 9*b* is completed, the sound source keeps generating the musical tone. Upon elapse of the sound generating time, microcomputer 30 requests that the sound source stop the generation of the musical tone. Consequently, the sound source enters the release mode and performs rapid release of the musical tone to thereby stop generating the sound, as indicated in FIG. 9*c*.

The broken line shown in FIG. 9*c* indicates the musical tone waveform which would be attained if the sound stop request is not made to the sound source upon elapse of the sound generating time When a fixed sustain is included in the envelope of a musical tone waveform, the musical tone is normally kept generated endlessly if no sound stop request is made. As should be understood from the above explanation, however, according to this invention, the sound stop request is made to the sound source to forcibly stop the sound generation upon elapse of a predetermined sound generating time after the string triggering, thus completely overcoming the conventional, problem of endless sound generation.

According to one preferred structure, independent sound generating times are set for different timbres. For instance, with respect to the timbre of an organ, the sound generating time is set to be relatively longer so as not to lose the natural sounds of the organ. Such time setting can be made by makers or can be programmed such that the sound generating times can be varied by users in accordance with different timbres. In this case, artificial selection of a sound generating time shorter than the natural one can provide a musical tone of a different timbre.

According to another arrangement, identification data for discriminating whether the timbre is of a sustain tone system or a release tone system is provided such that, only when the presently selected timbre is of the sustain tone system, the sound generating time needs to be measured and the sound stop request should be made upon elapse of the time.

The fifth feature is a string-based sound stop function which stops only the presently-generated musical tone for each string when the fret status is changed from a string-depressed status to an open-string operated status (the state in which every fret switch belonging to the triggered string is OFF, i.e., the open fret state). This function produces an effect similar to the one often obtained by playing an acoustic guitar, etc., i.e., by lightly depressing a vibrating string with left fingers, etc. to stop the vibration, thereby stopping the generation of a musical tone originated from the string vibration.

The principle of the above function will be explained below with reference to FIG. 10*a*–10*c*. Assume now that the triggering of a string 4 is detected by the ON state of the associated string trigger switch TSW, as shown in FIG. 10*a*. Then, in response to this detection, microcomputer 30 selects the proper sound source module in musical tone generating circuit 60 and requests the module to generate a musical tone with the pitch corresponding to the position of the presently-selected fret (which has already been described earlier). In FIG. 10*a*, at the string-triggered point (where the string trigger switch input is ON), any fret switch belonging to the triggered string is at the ON state or at a nonopen-string operated state. Accordingly, a musical tone waveform as shown in FIG. 10*c* is generated in the sound source module with the pitch corresponding to the turned-on fret switch. Then, when the string-depressing finger is moved off the fret position during generation of the musical tone corresponding to the string and the presently-actuated fret switch is turned off to be at the open-string operated state, as shown in FIG. 10*b*, microcomputer 30 makes a sound stop request to the sound source module which is presently generating a musical tone signal. This sets the sound source module to be in the release mode so that it performs the rapid release of the presently-generated musical tone to stop the generation of the sound.

The sixth feature is a full string sound stop function which stops the generation of all the musical tones generated by all the triggered strings when the state of all strings becomes the open-string operated state as a result of the fret operating position of an arbitrary string or the fret operating positions of plural strings being changed to the open-string operated state. This function can ensure that the generation of the musical tones of all the strings is stopped at one time only by the fingering operation of the left-hand left fingers. For instance, when a player giving a chord performance performs the picking of all or a plurality of strings while depressing a specific string at a given fret position with a the left-hand finger, e.g., a the left-hand middle finger, those strings other than the one depressed with the middle finger start producing musical tones with the pitches attained by open strings and the finger-depressed string starts generating a musical tone with the pitch corresponding to the fret position. If, in the above case, the left middle finger is also moved off the fret, all the strings are then in the open fret state (i.e., every fret of every string being at the open state) in accordance with the fret opening. At the full string open state, every fret switch FSW is at the OFF state. When informed of this full string open state, microcomputer 30 takes it as a full string sound stop request and causes all the presently-generated musical tones to be stopped. As a result, all the sound sources (those sources which are presently generating sounds) provided for the strings simultaneously enter the release mode and release the presently-generated musical tone signals. According to this example, the time from the point at which the string status is changed to the full string open status due to the fingering done by the left-hand finger of the player to the point at which stopping the generation of the musical tones of all the strings in the instrument starts is negligible and a significantly high response is attained, thus ensuring simultaneous stopping of the generation of all the musical tones.

This function ensures a clear-cut performance such as staccato. Further, since this function is initiated by easy fingering done on the fingerboard by left fingers, the music performing operation is so simple and easy that even a novice can handle the function with hardly any problem. In addition, the function can greatly assist to the simulation of performances for an acoustic guitar, etc.

The string-based sound stop function performed under the condition that the string status is changed to the open string status from the string-depressed status as described earlier with reference to FIGS. 10*a*–10*c* and the pitch changing function performed under the condition that the fret status is changed from the string-depressed status (fret-operated status) to another fret operated status as described earlier with reference to FIG. 7*a*–7*c* can be fully and independently performed when the pitch changing conditions do not include the transition to the open-string operated status. However, when the transition to the open-string operated status belongs to the pitch changing conditions (one of the changes in fret status), there will be a contention between the pitch changing function and the string-based sound stop function, only with regard to this change. It is significantly desirable for the performer that the response of a musical tone to the transition from the depressed-string operated status to the open-string operated status be varied depending on the state of the performance. More specifically, various performance needs of a performer can be met if, upon occurrence of the transition from the depressed-string operated status to the open-string operated status, under one circumstance, the generation of a presently-generated musical tone is stopped from the point of time at which the transition is made, and if, upon occurrence of the same transition, but under a different circumstance, the pitch of the musical tone corresponding to the depressed-string operated status is changed to the one corresponding to the open-string operated status when the transition occurs.

Figure 22A:
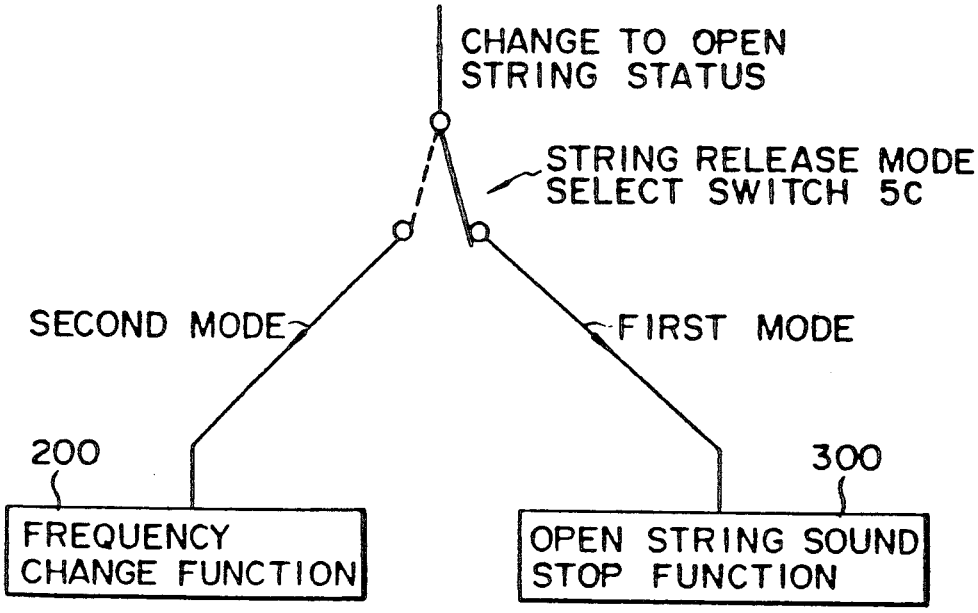
FIG. 22A is a diagram illustrating the switching between the frequency change function and open-string sound stop function, which is executed by a release string mode select switch.

According to this embodiment, therefore, to satisfy these requirements, string release mode select switch 5c, which can be operated, as desired, by a performer, is provided in the instrument's main body. When a mode to select the open string sound stop function is specified by this mode select switch 5c, as shown in FIG. 22A, selection means selects the open string sound stop function 300, not the pitch change function 200 at the time of the transition from the depressed-string operated status to the open-string operated status. A a result, the sounding of the presently-generated musical tone is stopped. On the other hand, when a mode to select the pitch change function is specified by mode select switch 5c, the selection means selects the pitch change function 200 by priority with respect to the transition to the open-string operated status. Consequently, the pitch of the presently-generated musical tone is changed to the one corresponding to the open-string operated status. The above-described string release mode select function is the seventh feature of this embodiment.

The eighth feature is a rapid sound stop function which ensures rapid sound stop by a manual operation as well as ordinary sound stop, which is initiated when ordinary sound stop conditions are satisfied. The principle of this function is illustrated in FIG. 11a–11c. As described above, the generation of a musical tone starts when a string trigger switch TSW is turned on as shown in FIG. 11a–11c (specifically, see FIGS. 11a and 11c). In this, however, mute switch 5b (see FIG. 1) is depressed during generation of the musical tone. In response to this depressing action, microcomputer 30 makes a rapid sound stop request to the sound source module which is generating the musical tone signal. Upon receipt of this request, the sound source module rapidly releases the generated musical tone signal to stop the sound generation.

The addition of such a rapid sound stop function can provide an acoustic effect similar to the one attained by the cutting technique of an acoustic guitar, etc.

It is illustrated in FIG. 11a–11c that the actuation of mute switch 5b influences only a single musical tone waveform; however, in an example to be described later, when mute switch 5b is turned on, the rapid sound stop request is made to all the sound source modules which are generating musical tones. That is, all of the presently-generated musical tones are simultaneously subjected to rapid muting.

The ninth feature is a mute reserve function performed by mute reserve switch MSW (see FIG. 1). With this function, once mute reserve switch MSW provided in the instrument's main body is operated in advance to reserve the muting, when a predetermined time elapses after generation of a musical tone by picking a string, sounding of the musical tone of the string is rapidly stopped. (The time is measured by a counter or timer means.) In response to a vibration start signal from string trigger switch TSW, microcomputer 30 causes the sound source to generate the musical tone of the triggered string and activates the timer means to measure the elapse of the predetermined time. If the muting has been assigned in advance, microcomputer 30 requests the sound source to rapidly stop generating the sound upon occurrence of the time-out of the timer means. This puts the sound source to the rapid release mode so that the generated musical tone signal is rapidly released This arrangement can very easily provide an acoustic effect similar to the muting effect which is produced by an acoustic guitar, etc.

The following detailed explanation will make it apparent as to how the above explained characterizing functions and other functions are specifically realized

Latch Circuit (FIG. 12)

FIG. 12 illustrates an example of the structure of latch circuit 40 shown in FIG. 4, which is used to realize the first feature of this embodiment, i.e., the accurate string triggering detection function. In the figure, TRI1 to TRI6 are the outputs of string trigger switches TSW respectively provided to the first to sixth strings 4. For instance, TRI1 is the output of the string trigger switch TSW of the first string. The individual switch outputs TRI1 to TRI6 become "L" by the ON states of the respective string trigger switches TSW and become "H" by their OFF states. These switch outputs TRI1-TRI6 supplied through their respective inverters I1-I6 to the inputs of their associated latch circuits 40-1 to 40-6, which are designed to function as RS flip-flops. The transition of the level from "H" to "L" of switch outputs TR1-TR6 sets the associated latch circuits 40-1 to 40-6 so that the outputs TR01-TR06 of the set latch circuits become "H." That is, when a string trigger switch TSW is turned on for the first time, the associated one of latch circuit 40-1 to 40-6 is set and the output of the latch circuit is thereafter kept at "H." The individual latch outputs TR01-TR06 are periodically sampled by microcomputer 30 in the string triggering detection step G2 shown in FIG. 5 (whose detailed description will be given later). As will be described later, microcomputer 30 detects the string triggering by detecting a change in the status of each latch circuit from the reset status ("L" state) to the set state ("H" state) and controls the timing of musical tone generation. After detecting the string triggering, microcomputer 30 also measures the elapse of a predetermined time and resets latches circuits 40-1 to 40-6 through the associated latch reset inputs CR1 to CR6 shown in FIG. 12 upon elapse of that time.

Figure 13:
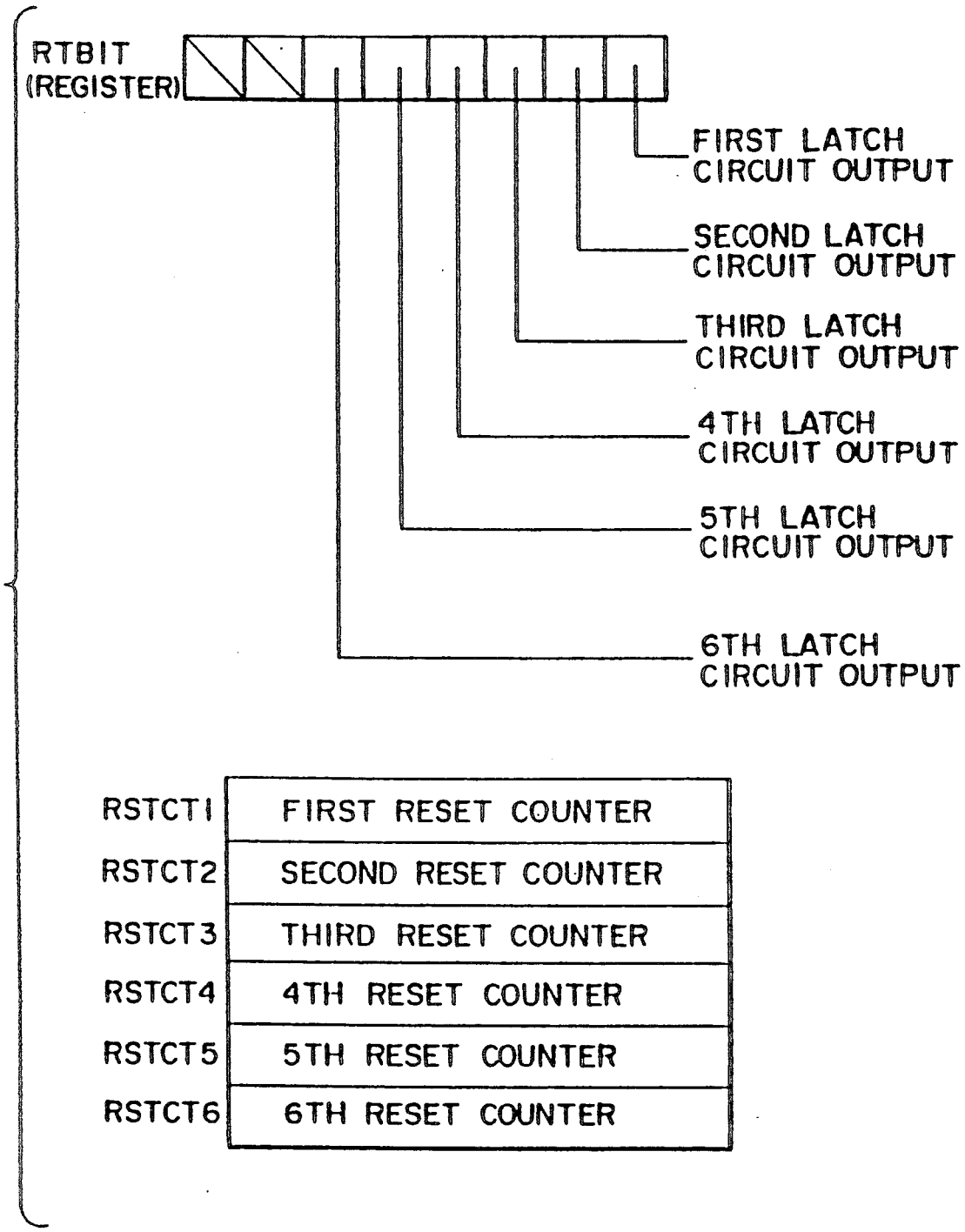
FIG. 13 is a diagram illustrating registers associated with string triggering detection.

Registers Involved In String Triggering Detection (FIG. 13)

FIG. 13 illustrates a part of a group of registers which are provided in microcomputer 30 and used for detecting the string triggering. The register denoted by RTBIT is used to store previous sampled values of the individual outputs of the aforementioned latch circuits 40-1 to 40-6. As illustrated, the least significant bit of register RTBIT holds the previous sampled value of the first latch circuit 40-1, the second bit of the register holds the previous sampled value of the second latch circuit 40-2, and so forth up to the sixth bit holding the previous sampled value of the sixth latch circuit 40-6. Registers RSTCT1 to RSTCT6 are reset counters used to measure the time for resetting the associated latch circuits 40-1 to 40-6 upon detection of the string triggering. For instance, when the triggering of the first string is detected through latch circuit 40-1, a predetermined value is set in the first reset counter RSTCT1, and is down-counted for each predetermined time interval. When a borrow is output, i.e., when the reset counter underflows, a reset signal is sent to latch circuit 40-1.

Figure 14:
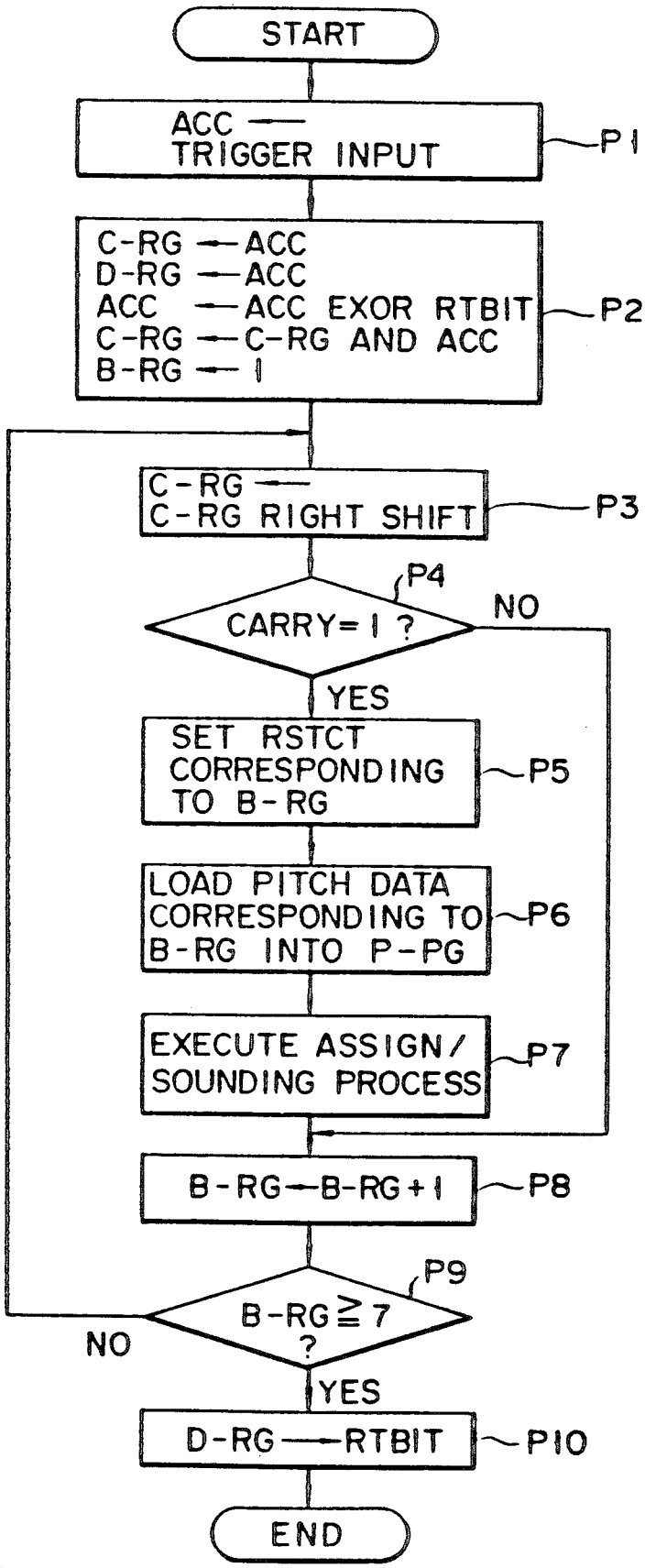
FIG. 14 is a detailed flowchart of a string triggering detection process.

Triggering Detection Process (FIG. 14)

FIG. 14 is a detailed flowchart of the triggering detection step G2 (FIG. 5). First, in step P1, latch circuit outputs TRO1-TR06 shown in FIG. 12 are latched in an accumulator ACC of microcomputer 30. The sampled values TR01 to TR06 are set in accumulator ACC respectively from the least significant bit to the sixth bit, leaving the highest two bits unused. Registers ACC, B-RG, C-RG and D-RG are each of 8 bit capacity. In the next step P2, the illustrated processes are executed. In this step, "EXOR" indicates an exclusive OR operation while "AND" indicates a logical product. Through the step P2, the sampled values of the present latch outputs are saved in register D-RG, and the first to sixth bits of register C-RG are respectively set with "H" or "1" only when the sampled values of the associated, previous latch outputs are "L" but the sampled values of the corresponding present latch outputs are "H," and are set with "L" or "0" otherwise. As a string number, "1" indicating the first string is set in register B-RG.

The loop from steps P3 to P10 executes the triggering process from the values of the individual bits of register C-RG. In step P3, register C-RG is right shifted by one (in the direction from higher bits to lower bits) and the most significant bit MSB of register C-RG is set with "0" and bit CARRY is set with the value of the least significant bit LSB. The value of CARRY is discriminated in the next step P4. CARRY=1 in step P4 indicates that some string is triggered (more specifically, the first ON state of string trigger switch TSW of one string is detected through latch circuit 40) and the number of the triggered string is given by string number register B-RG. If CARRY=1 in step P4, the flow advances to step P5 where a predetermined value (time data for resetting the latch circuit) is set in the reset counter RSTCT corresponding to the value of register B-RG. In the next step P6, of the pitch data of the individual strings which is saved in the fret status detection step G3 as shown in FIG. 5, the pitch data of the string number indicated by the value of register B-RG is loaded in register P-RG. Then, the flow advances to step P7 where assigning a sound source of musical tone generating circuit 60 (FIG. 4) and generating a sound are executed in accordance with the string number 1 and the pitch data.

After step P7 or when CARRY=0 in step P4, the flow advances to step P8 where the value of register B-RG is incremented by one to advance the string number by one. In the next step P9, it is determined whether or not the value of register B-RG is equal to or less than 6, and if it is equal to or less than 6, the flow returns to step P3 and repeats the above-explained loop.

When the loop process is completed for all the strings, the flow advances to step P10 where the presently-sampled latch output or the content of register D-RG is saved in register RTBIT. The saved data is used as the previous sampled value in step P2 when the next triggering detection flow (FIG. 14) is executed.

Figure 15:
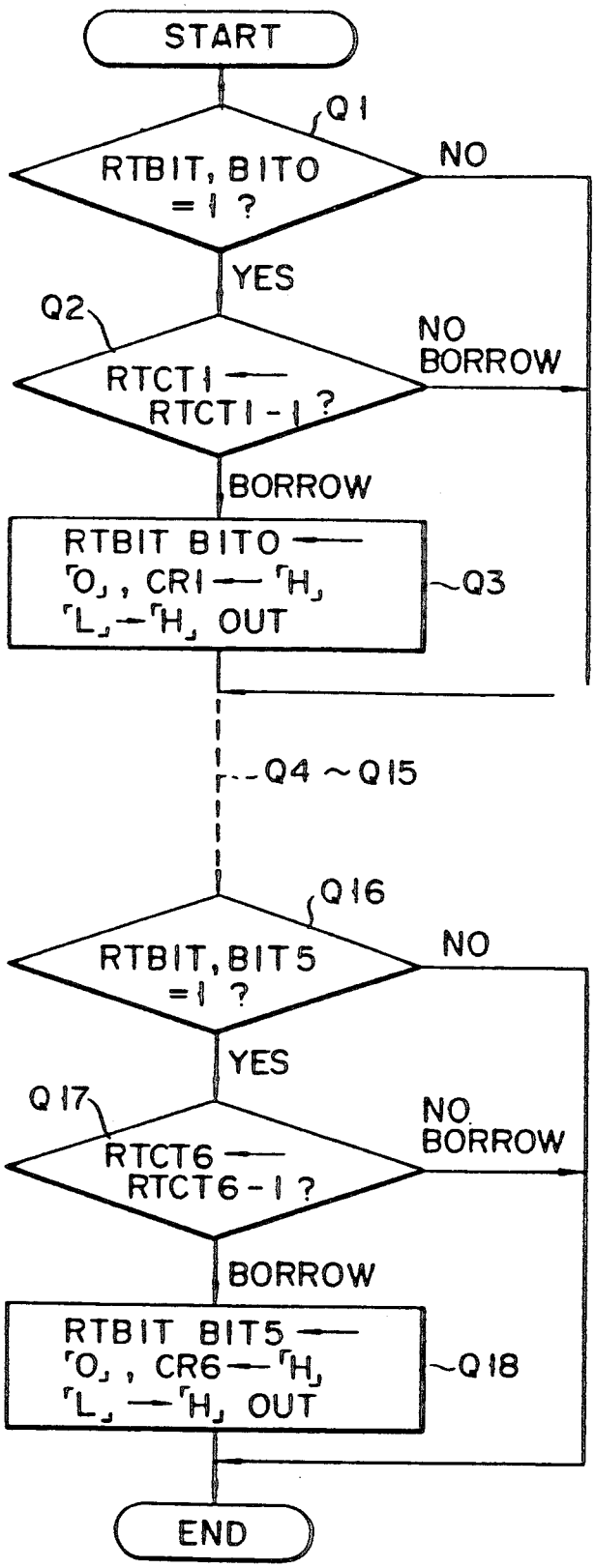
FIG. 15 is a flowchart of an interrupt routine involved in resetting the latch circuit.

Latch Reset Process (FIG. 15)

As described above, time data for resetting the latch circuit is set in reset counter RSTCT (FIG. 13) of a triggered string in step P5 of the triggering detection flow (FIG. 14). With regard to this step, microcomputer 30 performs a process for resetting latch circuits 40-1 to 40-6 upon elapse of a predetermined time from the point of time when the string triggering has started, in a time interrupt routine to send an interrupt signal at a predetermined interval. FIG. 15 illustrates the flow of the latch resetting process (time interrupt routine). The steps Q1 to Q3 are the sequence of the latch resetting process for the first string. In step Q1, it is determined whether or not the first bit of register RTBIT is "1∝ in order to discriminate whether or not the first latch circuit 40-1 (see FIG. 12) corresponding to the first string is set. If the decision is affirmative in this step, the flow advances to step Q2 where reset counter RTCT1 of the first string is down-counted and if there is a borrow, the first bit of register RTBIT is set to "0" so as to output a low pass to latch reset line CR1 of the first latch circuit 40-1. As a result, latch circuit 40-1 is reset.

Similarly, the latch reset steps Q4-Q18 for the second to sixth strings are performed.

[Review of String Triggering Detection Function]

Figure 16:
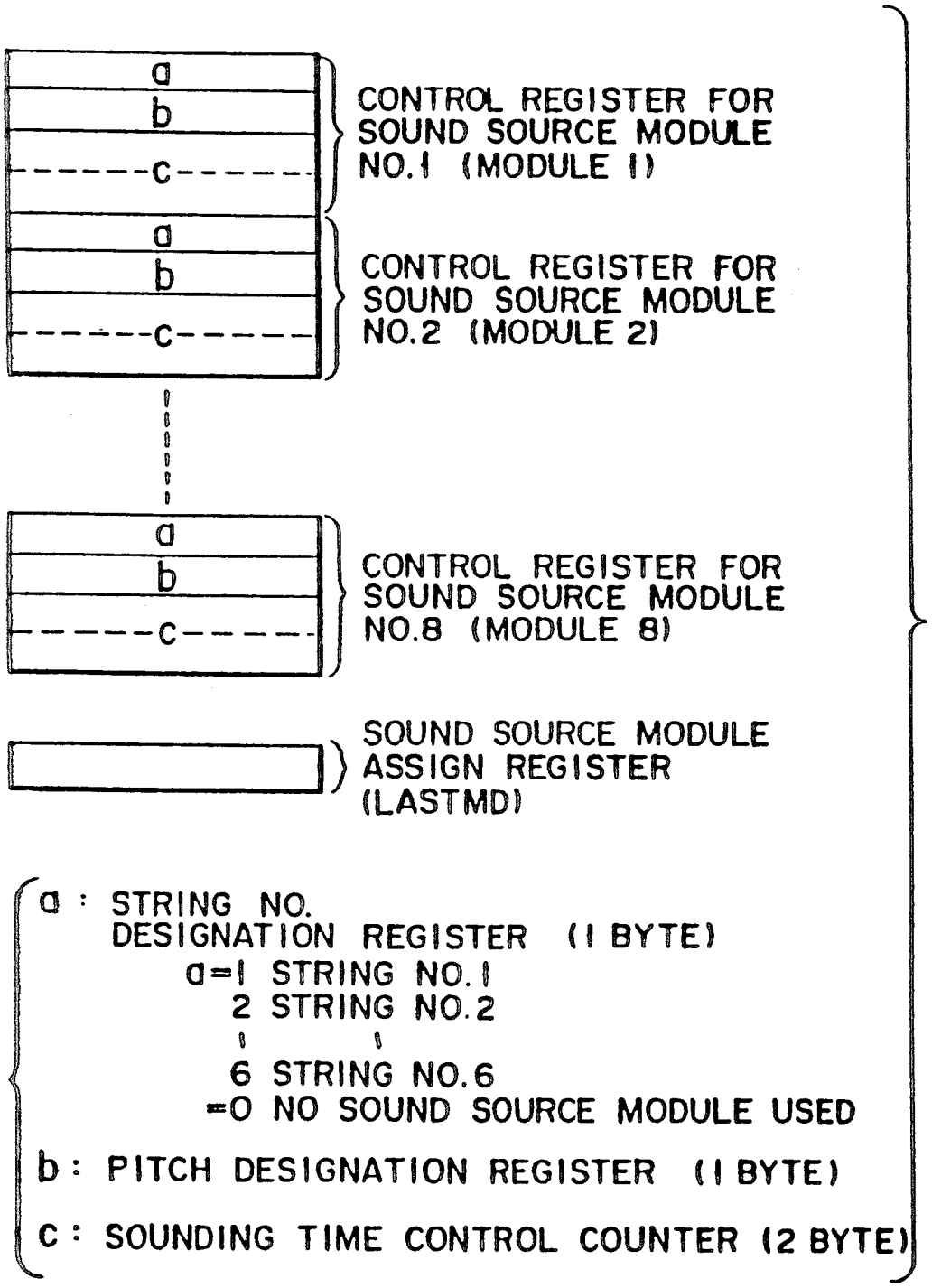
FIG. 16 is a diagram illustrating sound source control registers.
Figure 17:
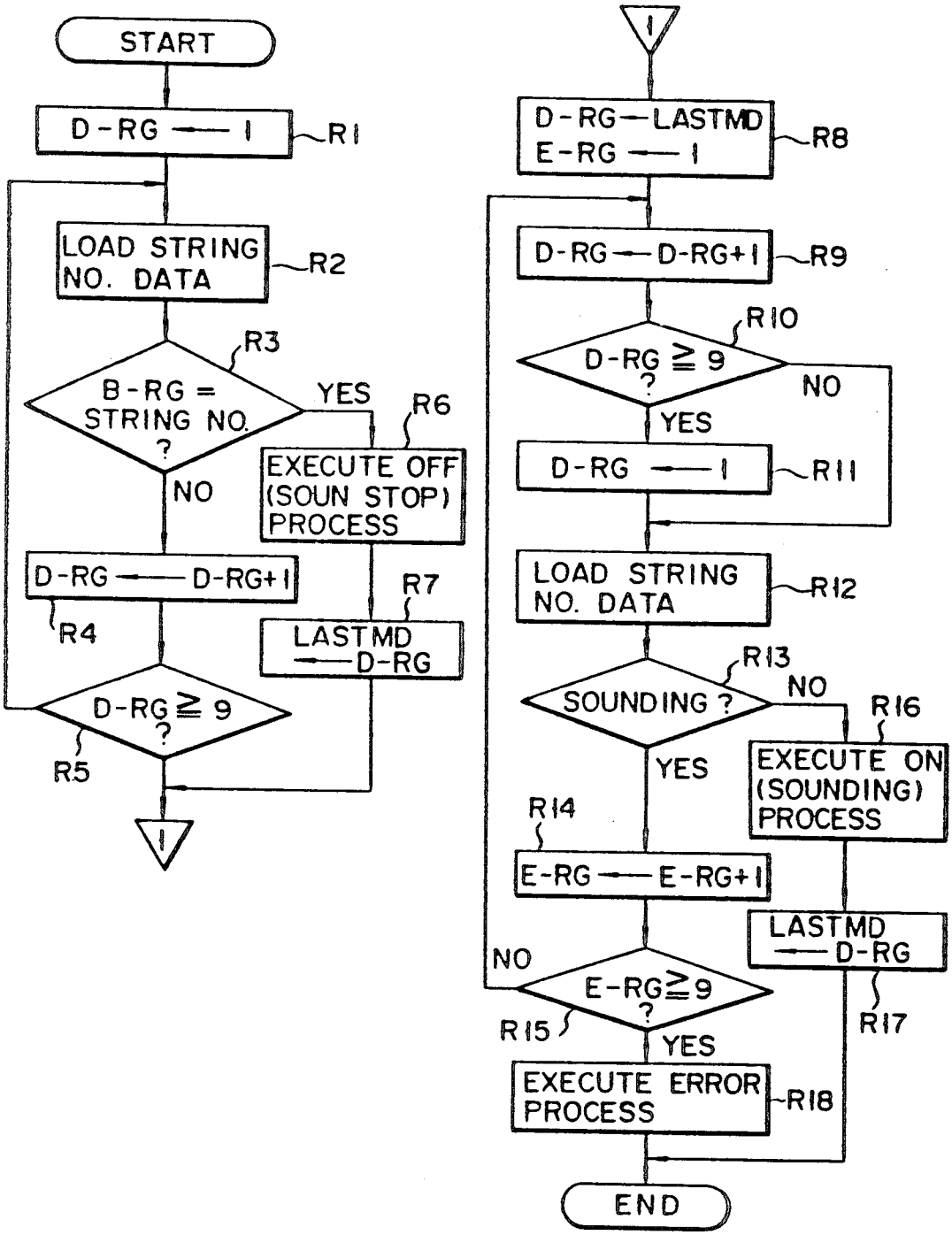
FIG. 17 is a detailed flowchart of a sound source assigning/sound generating process shown in FIG. 14.

By now it should be understood that the present embodiment has an assured string triggering detection function. When each string 4 (FIG. 1) starts vibrating, the associated string trigger switch TSW (FIG. 3) is switched on, thus setting the associated one of latch circuits 40-1 to 40-6. At the time of the next latch data sampling after the latch setting process, microcomputer 30 (FIG. 4) executes the triggering detection process as shown in FIG. 14 and detects which string is triggered from the result of comparison between the present and previous latched samples. Based on the detection, microcomputer 30 executes the process for starting the sound generation, etc. (see steps P6 and P7) and sets the reset counter RSTCT (FIG. 13) of the triggered string in step P5. The reset counter RSTCT is down-counted upon every occurrence of an interrupt in the latch reset process (time interrupt routine) as shown in FIG. 15. Consequently, when a predetermined time elapses after the triggering of the string, the reset counter RSTCT underflows and that one of latch circuits 40-1 to 40-6 which is associated with the triggered string is reset (see step Q3, for example). Therefore, the string triggering detection function described with reference to FIG. 6*a*–6*d* is surely realized Assign/Sounding Process (FIGS. 16 and 17)

The sound source assigning/sound generating step P7 in the flow of FIG. 14 will now be explained in detail.

In the sound source assigning/sound generating step, microcomputer 30 (FIG. 4) controls the generation of a musical tone of the triggered string and also realizes the third feature of this embodiment, namely, the tone reverberation function when the same string is picked in succession.

Before going into the explanation of the detailed flow of the sound source assigning/sound generating step, some of registers used in this flow will be explained below.

FIG. 16 illustrates the control registers for the individual sound source modules of musical tone generating circuit 60 (FIG. 4). (In this example, circuit 60 is constituted by eight sound source modules.) In FIG. 16, eight registers MODULE1 to MODULE8 respectively correspond to sound source modules No. 1 to No. 8 of musical tone generating circuit 60, and each control register comprises a string number designation register a, a pitch designation register b and a sounding time control counter c. String number designation register a is written with a value corresponding to the number of the string generating a musical tone, e.g., "1" for the first string. If this value is zero, however, it indicates that the associated sound source module is not presently used for tone generation. Pitch designation register b is written with pitch data of the presently-generated musical tone. Sounding time control counter c is for measuring the elapse of the tone generation time from the start of the tone generation and is set with a predetermined value when the associated sound source generates a sound. Register LASTMD is used for assigning a sound source module and its function will be explained later.

In FIG. 17, sound source number designation register D-RG holds a value corresponding to the number of a sound source module and loop count register E-RG is for counting the loop.

The flow of the sound source assigning/sound generating step will be explained referring to FIG. 17.

The first half (R1–R7) of the flow is for searching the individual sound source modules of musical tone generating circuit 60 for the one which has already generated the musical tone corresponding to the presently triggered string, and requesting, if found, that sound source module to stop the tone generation. The second half (R8–R18) of the flow is for finding a sound source module (unused module) to newly generate the musical tone corresponding to the presently triggered string and requesting that module to start generating the musical tone.

In the first step R1, a value "1" indicating sound source module No. 1 is written in sound source number designation register D-RG. In other words, sound source module No. 1 is designated. In step R2, the contents of string number designation register a of the sound source module control register, which corresponds to the value of register D-RG is loaded. In other words, the number of the string whose musical tone is presently generated from the presently designated sound source module No. 1, is read out. Then, in step R3, the value of string number designation register B-RG which indicates the number of the presently-triggered string is compared with the number of the string whose musical tone is generated by the presently-designated sound source module No. 1. If the compared values are not equal to each other, it means that the presently-designated sound source module No. 1 is not generating the musical tone corresponding to the presently-triggered string. In this case, this module No. 1 is either generating the musical tone of another string or is not generating any tone and is not busy. In this case, the value of register D-RG is incremented by one in step R4, i.e., the next sound source module No. 2 is designated, and it is then discriminated whether or not the value of register D-RG is greater than or equal to 9. If it is less than or equal to 8, the flow returns to step R2, so that the loop is repeated.

The value of register B-RG may equal to the value (string number) of string number designation register a in step R3. This means that the presently-designated sound source module has already generated the musical tone of the presently-triggered string. In the next step R6, therefore, the presently-designated sound source module is subjected to the sound stop process and string number designation register a of the sound source module control register associated with that sound source module is set with zero, thereby indicating that the sound source module is being not busy (or generating no musical tone). In the next step R7, the value of sound source number designation register D-RG or the number of the sound source module which has just stopped generating a musical tone, is written in sound source module assign register LASTMD. The register LASTMD is for controlling the assigning the sound source module for tone generation and is used to start the search for the sound source module for tone generation, whose number follows the value of LASTMD (i.e., the number of the sound source module previously assigned for tone generation (see steps R16 and R17) or the one previously having stopped the tone generation).

In the first step R8 of the second half of the flow, the value of register LASTMD is set in register D-RG and a value "1" is written in loop number register E-RG. In the first three steps R9 to R11 of the loop (steps R9–R15), the number of the next sound source module to be checked is computed and the computation result is written in register D-RG. In step R12, the content of string number designation register a of the control register of the that sound source module is loaded, and in next step R13, it is discriminated whether or not the content of register a is zero, i.e., whether or not the sound source module under examination is presently generating a musical tone (or is presently used). If the module is generating the musical tone, the value of register E-RG is incremented by one. Then, in step R15, it is discriminated whether or not the value of register E-RG is less than or equal to 8, and if it is less than or equal to 8, the flow returns to step 9 so as to repeat the loop. If the value of register E-RG is greater than or equal to 9 in step R15, however, it means that all of the eight sound source modules are in use. Logically, this event does not occur and it indicates that a memory is damaged by external factors, so that the proper error process is executed in step R18.

If it is discriminated in step R13 that the sound source module under examination is not generating a musical tone, the flow advances to step R16 where this sound source module (the one corresponding to the value of register D-RG) is requested to start generating a musical tone with the pitch determined by the pitch data of the musical tone of the presently-triggered string, which is the content of pitch designation register P-RG. At the same time, the value of register B-RG or the number of the presently-triggered string is written in string number designation register a of the control register of that sound source module, the value of register C-RG or the pitch data of the presently-generated musical tone is written in pitch data designation register b, and a predetermine value (sounding time data) is written in sounding time control counter c. Finally, in step R17, the value of register D-RG or the number of the sound source module which has just undergone the ON process (step R16), is written in sound source module assign register LASTMD.

[Review of Tone Reverberation]

By now the third feature of the present embodiment, namely, the tone reverberation function, should be understood; that is, when the same string 4 is stroked successively while reverberation is occurring of the musical tone generated by the previous string triggering, the generation of the musical tone originating from the succeeding string triggering starts.

For instance, when one string 4 is triggered for the first time, the string triggering is detected through the flow of the triggering detection process as shown in FIG. 14, and a predetermined sound source module is assigned to generate the associated musical tone at the second half (steps R8-R18) of the flow of the sound source assigning/sound generating process (step P7 of FIG. 14 and FIG. 17) and it is memorized that this sound source module is generating the musical tone associated with the triggered string.

When the same string 4 is triggered again under such a circumstance, this triggering of the specific string 4 is also detected. This time, however, the first half of the flow of the sound source assigning/sound generating process (FIG. 17) does not go through the ordinary sequence; it is confirmed in step R3 that the generation of the musical tone associated with the presently-triggered string has "already" been done by a specific sound source module in musical tone generating circuit 60 (FIG. 4) and this sound source module is subjected to the sound stop process (step R6). In the second half of the flow, a new sound source module is assigned to newly generate the musical tone associated with the presently-triggered string and this new module is subjected to the sound stop process (step R16).

Here, the sound source module which is to stop the tone generation generally differs from the one which is to start the tone generation. Particularly, in the flow of FIG. 17, searching for the sound source module to newly generate a musical tone starts from the one following the module which has undergone the OFF (sound stop) process in step R6 and the first unused (a=0) sound source module found is used to generate the musical tone associated with the newly-triggered string. In other words, the new sound source module can certainly be found before the search reaches the sound source module which has undergone the sound stop process (see the operation of register LASTMD). In the case of very exceptional string operation (e.g., all the strings being stroked at a very high speed), however, the sound source module which has undergone the OFF (sound stop) process to provide the tone reverberation will be immediately selected as a new sound source module in order to perform the tone assignment of the sequence of the string triggering. Practically, however, this does not cause any problem. The processes shown in FIGS. 14 and 17 are designed to optimally select a different sound source module to be subjected to the ON process from the one which has undergone the OFF process, when the same string is stroked successively under the condition of the restricted number of sound source modules.

In short, according to this embodiment, when, during generation of a musical tone originating from the triggering of one string, the same string is triggered again, the sound source module which is generating the musical tone associated with the string is caused to stop the tone generation and a different sound source module is assigned to generate the new musical tone in response to the new triggering of the string. Accordingly, the tone reverberation function as described with reference to FIG. 8a-8b can be realized As a modification, two (or more) sound source modules may be assigned to each string, so that at the first string triggering, one of the two sound source modules is subjected to the ON process, and at the time of the second string triggering, this module is subjected to the OFF process and the remaining module is subjected to the ON process.

Further, tone generation assignment to the sound source module which has undergone the OFF process may be inhibited until this module completely stops the tone generation In this case, however, the number of assignable sound source modules is reduced by this inhibition, thus requiring a large number of sound source modules in total.

When the timbre is of the release tone system such as guitar sounds, the OFF process executed in step R6 of FIG. 17 may be eliminated. With instruments using both the release tone system and sustain tone system, additional discrimination step may be provided following discrimination step R3 in FIG. 17 to discriminate whether the release tone system or the sustain tone system is involved, and if it is the sustain tone system, the OFF process in step R6 is executed and if it is the release tone system, then the OFF process may be omitted.

Figure 18:
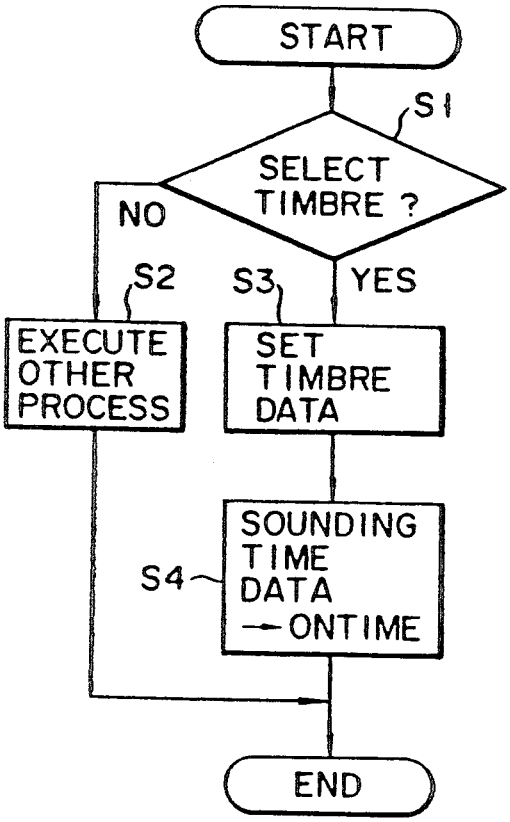
FIG. 18 is a flowchart for setting the sounding time.
Figure 19:
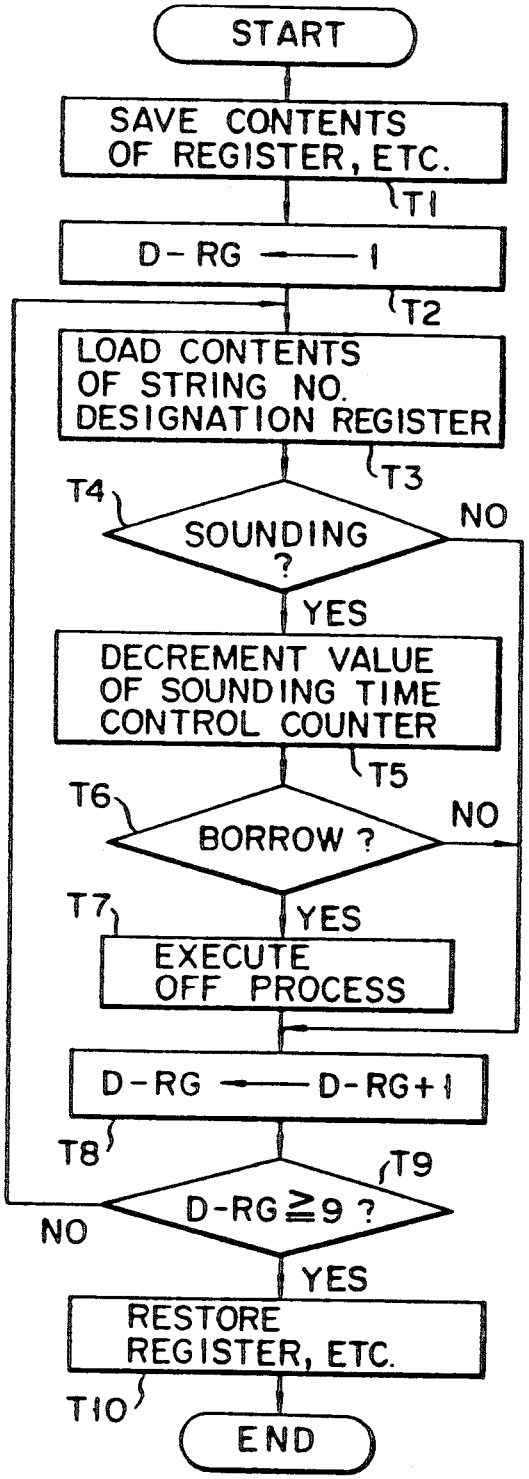
FIG. 19 is a flowchart of an interrupt routine associated with a sounding time control.

Sounding Time Control Process (FIGS. 18 and 19)

As described above, when string triggering occurs, it is detected by microcomputer 30 (FIG. 4), and through the flow of sound source assigning/sound generating process shown in FIG. 17, an unused sound source module is found from all the sound source modules of musical tone generating circuit 60 (FIG. 4) in order to generate the musical tone associated with the triggered string and this module is subjected to the ON process in step R16. And, the sounding time data is written in sounding time control counter c (FIG. 16) of the control register of that module in step R16.

In this embodiment, the sounding time data is determined for each timbre, and when a timbre is designated by timbre select switch 5a (FIG. 1), the sounding time data representing the length of time which corresponds to the selected timbre is set in register ONTIME (see FIG. 18; its detailed explanation will be given later). That is, it is the sounding time data determined by the presently-selected timbre which is to be set in sounding time control counter c in step R16 (ON process) in the flowchart shown in FIG. 17. Microcomputer 30 performs a decrement operation on the sounding time data set in counter c for each execution of the interrupt routine (the flow of the timed-out stop sound process as shown in FIG. 19), which puts an interrupt for each predetermined time interval. And, when the underflow of sounding time control counter c occurs, microcomputer 30 causes the associated sound source module to stop the tone generation.

The sounding time control process will now be explained in detail. FIG. 18 illustrates a detailed flowchart of the timbre designation change process which is part of panel switch status change process executed in step G8 of FIG. 5. First, it is discriminated in step S1 whether or not a new timbre is designated by timbre select switches 5a (FIG. 1). If no timbre designation is made, other processes are performed in step S2, but if the new timbre designation is made, the flow advances to step S3 where timbre data associated with the designation is set. Further, sounding time data corresponding to the designation timbre is saved in sounding time data save register ONTIME.

FIG. 19 is a detailed flowchart of the timed-out sound stop process, and microcomputer 30 executes the illustrated interrupt routine for a predetermined time interval. First, data saving in a register, etc. is executed in step T1 as per an ordinary interrupt routine. The value of sound source number designation register D-RG, which indicates the number of the sound source module, is initialized to be 1 in step T2, and thereafter the loop T3 to T9 is executed.

In the first step T3 of the loop, the content of string number designation register a of the sound source module to be checked is loaded (when a=0, the sound source module is presently unused, and when a=0, the a-th string is generating a musical tone). In the subsequent step T4, it is discriminated whether or not a=0, i.e., whether or not the sound source module is presently generating a musical tone. If the musical tone is being generated, sounding time control counter c for controlling the sound source module is down-counted in step T5. If a borrow from this counter is detected in step T6, the flow advances to step T7 where the sound source module is subjected to the stop sound process (OFF process), and the content of string number designation register a is set to zero to memorize that the sound source module is no longer generating a musical tone. After step T7 or when it is discriminated in step T4 that no musical tone is presently being generated, or when no borrow is detected in step T6, the flow advances to step T8 where the value of sound source number designation register D-RG is incremented by one. Then, in the subsequent step T9, it is discriminated whether or not the value of register D-RG is less than or equal to 8, and if the value is less than or equal to 8, the flow returns to step T3 to thereby repeat the loop.

After the loop is completed, data is restored in registers, etc. (step T10), as is the case where the interrupt process is completed.

With the above explanation, it should be understood that the fourth feature of this embodiment, namely, the function for automatically causing the sound source module to stop the tone generation upon elapse of the sounding time, is realized. The aforementioned sounding time data is prepared separately from the envelope data included in the timbre data, so that even during generation of the musical tone envelope or even during generation of the musical tone from the sound source module in accordance with the musical tone envelope data, when the time determined by the sounding time data elapses, the sound source module is requested to stop the tone generation from that instance.

As a modification, the sounding time data may be designed to be freely programmable (variable) by a user, thus providing timbres of different impressions.

Figure 20:
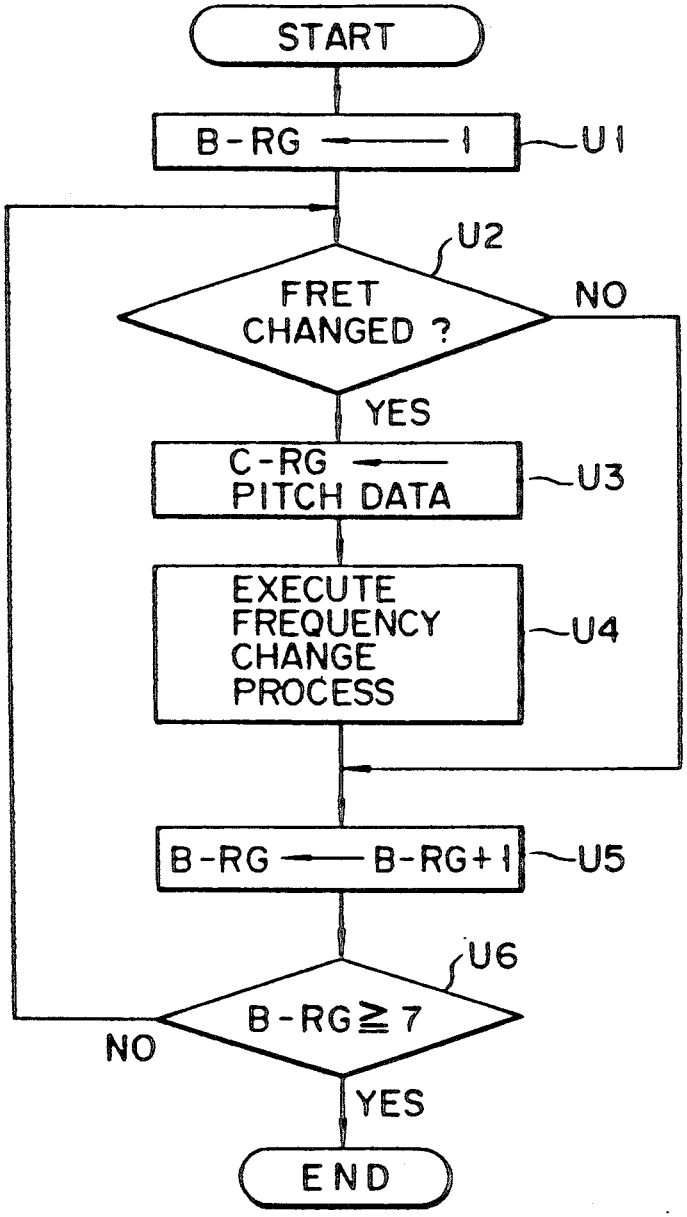
FIG. 20 is a detailed flowchart of a fret status detecting process.
Figure 21:
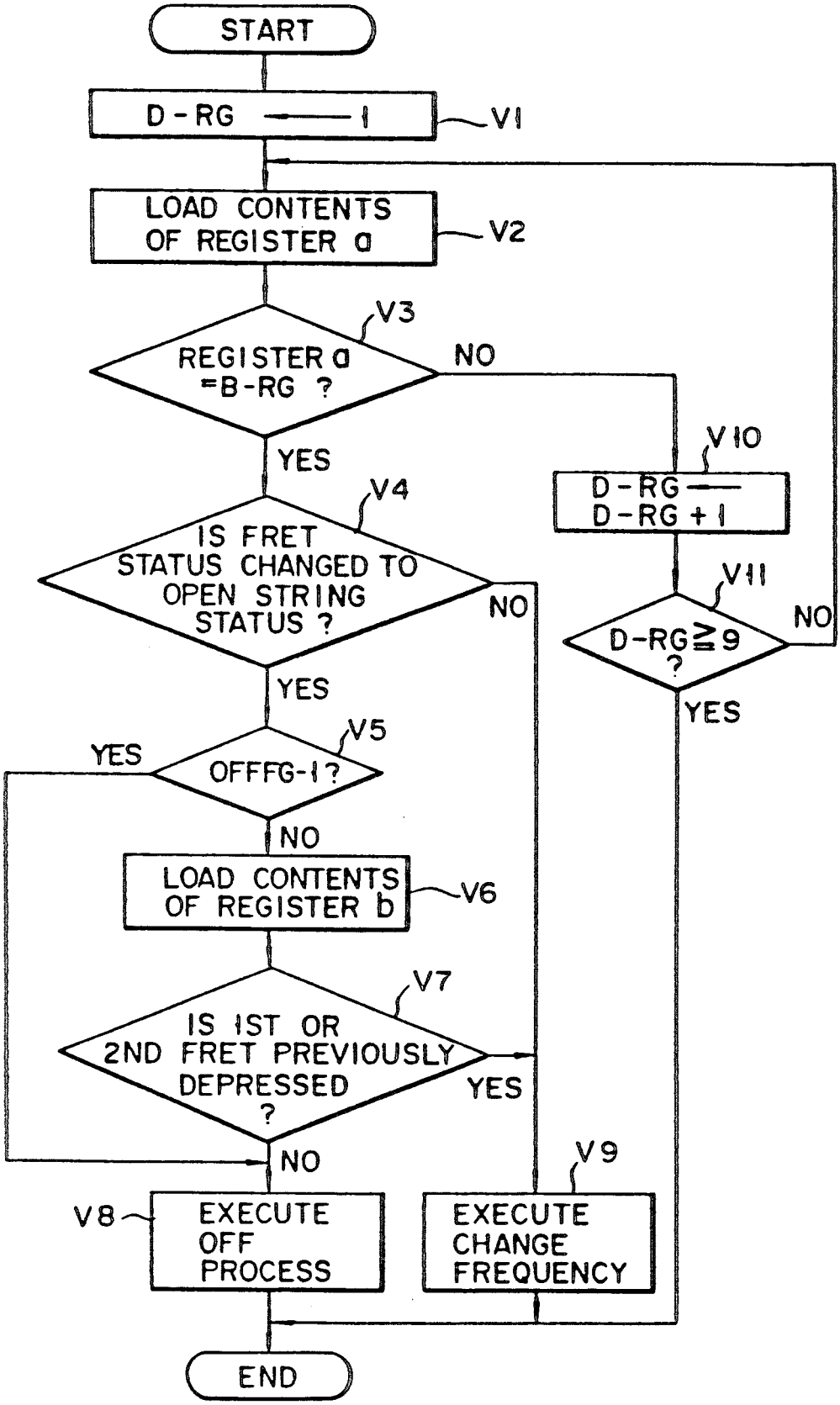
FIG. 21 is a detailed flowchart of a frequency change process shown in FIG. 20.

Fret Status Change Process (FIGS. 20 and 21)

The following explains the fret status change process performed by microcomputer 30 (FIG. 4) in step G5 of the general flow (FIG. 5).

FIG. 20 is a detailed flowchart of the fret status change process. Microcomputer 30 initializes string number designation register B-RG to have a value 1 in the first step U1 of the flowchart, and thereafter repeatedly executes the loop U2 to U6.

In the first step U2 of the loop, it is determined whether or not there is a fret change. This discrimination is done by comparing the previous sampled values of the fret switches belonging to the string indicated by the value of string number designation register B-RG with the present sampled values. The fret change includes a change from one depressed-string operated status to the so-called open-string (open-fret) operated status. If a fret change is detected in step U2, the pitch data associated with the changed fret position is written in pitch designation register C-RG in step U3. In the subsequent step U4, a frequency change process (FIG. 21; its detailed description will be given later) using both of the values of the aforementioned string number designation register B-RG and pitch designation register C-RG. If no fret change is discriminated in step U2, or after the frequency change process performed in step U4, the value of string number designation register B-RG is incremented by one to increase the string number by one in step U5. In the subsequent step U6, it is discriminated whether the value of register B-RG is less than or equal to 6, and while the value is less than or equal to 6, the loop starting from step U2 is repeated.

When the process for the fret change with respect to all the strings is completed, the value of register B-RG is determined to be 7 in step U6, thus leaving the flow of the fret status change process.

FIG. 21 is a detailed flowchart of the aforementioned frequency change process. At the time the flow starts, the pitch data of a changed fret is held in pitch designation register C-RG and a value (string number) indicating on which string the fret change occurred is held in string number designation register B-RG.

In step V1, the content of sound source number designation register D-RG is initialized to be 1. Then, the value (string number) of string number designation register a of the sound source module control register (FIG. 16) indicated by the value of register D-RG is loaded in step V2, and it is then discriminated in step V3 whether or not the loaded value of register a equals the value of string number designation register B-RG. That is, it is checked in step V3 whether or not the musical tone associated with the string whose fret position has changed is being generated. If the decision in this step is a noncoincidence, the flow advances to step V10 where the value of sound source number register D-RG is incremented by one to increase the number of the sound source module to be checked by one, and then advances to step V11 where it is discriminated whether or not the value of sound source number designation register D-RG is less than or equal to 8. If the value is less than or equal to 8, the flow returns to step V2 to thereby repeat the loop; if the value equals 9, the process is completed.

The value of register D-RG becomes 9 in step V11, thus completing the process, when a fret change occurs on the fret of the string associated with that musical tone which is undergoing the sound stop process. In such a fret change operation, the fret change is considered to be invalid so that no musical tone processing is performed.

When a fret change occurs with respect to the string associated with the presently-generated musical tone, there exists the sound source module which is generating the musical tone and this is stored in string number designation register a of the associated sound source module control register (see FIGS. 14 and 17). Therefore, when the value of register D-RG indicates a sound source module number, the value of register a= the value of string number designation register B-RG is satisfied in step V3.

If it is discriminated in step V3 that the musical tone associated with the string whose fret position has changed is presently being generated, the flow advances to step V4 where it is discriminated whether or not the fret status is changed to the open-string operated status by checking the value of pitch designation register C-RG. If the fret status is not changed to the open-string operated status (i.e., a different fret being depressed), the flow advances to step V9 where the sound source module, presently generating the musical tone associated with the string, (this module being determined by the value of sound source number designation register D-RG) is subjected to the frequency change process so as to change the frequency of the musical tone to the one corresponding to the pitch data indicated by the value of pitch designation register C-RG, and the value of register C-RG is written in pitch designation register b. In step V9, only frequency change is done as tone processing; stopping the tone generation, generating a new musical tone or the like is not performed at all. As a result, the presently-generated musical tone has its frequency change to the one corresponding to the changed fret position without generating a new musical tone (see FIGS. 7a–7c).

If it is discriminated in step V4 that the fret status is changed to the open-string operated status, the flow advances to step V5 where it is discriminated whether or not the value of a string release OFF process execute flag OFFFG is 1 (set.) If the value is 1, the OFF process is executed in step V8. More specifically, the sound source module which is presently generating the musical tone associated with the string is subjected to the sound stop process and string number designation register a of the control register for that module is written with zero which indicates that the module is unused.

If the value of flag OFFFG is determined to be 0 (reset) in step V5, the value of pitch designation register b is loaded in step V6. Here, the value of register b corresponds to the pitch for the fret status immediately before the occurrence of the fret change In subsequent step V7, it is discriminated whether the pitch data immediately before the occurrence of the fret change corresponded to the first fret position or the second fret position. If the decision is affirmative, the frequency is changed in step V9, thus completing the frequency change process. Step V7 is provided in this embodiment to mainly cope with the sliding of the same string When the fret status is changed to the open-string status after the third fret, therefore, it is assumed that a performer moves the string-pressing fingers onto strings to press them for playing a melody using a plurality of strings.

The flag OFFFG indicated in step V5 of FIG. 21 is used to realize the string release mode select function which is the sixth feature of this embodiment. Accordingly, this function can be controlled by string release mode select switch 5c (FIGS. 1 and 22A) provided in the instrument's main body.

Figure 22B:
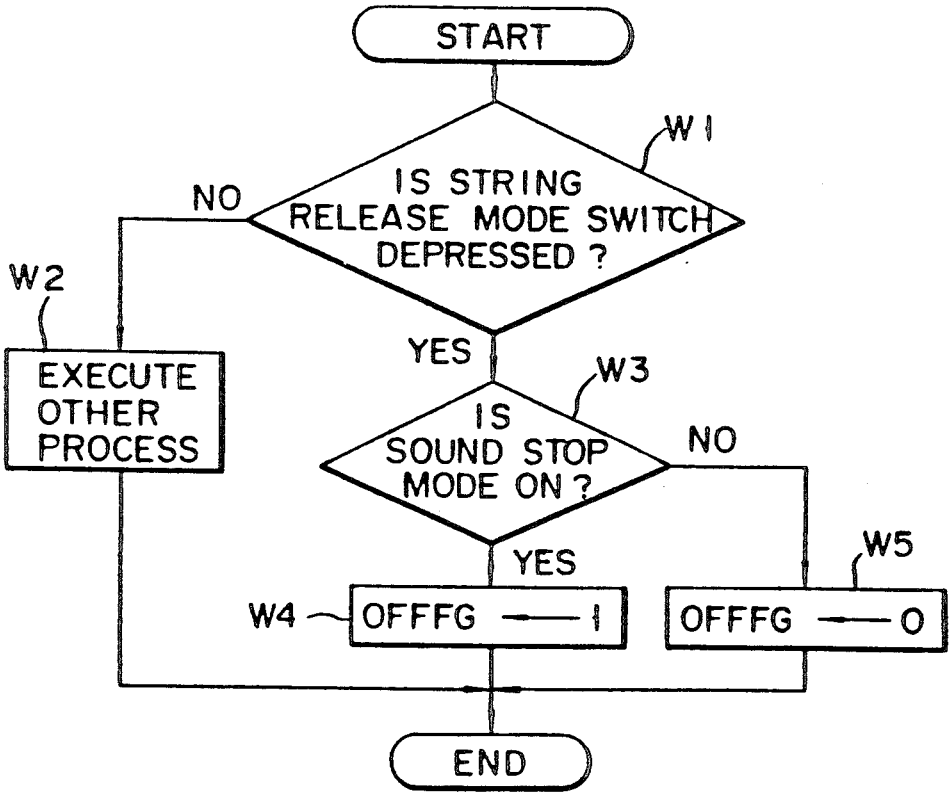
FIG. 22B is a flowchart with respect to a release string mode select switch input.

FIG. 22B illustrates the flowchart for switching the flag OFFFG with respect to the input of string release mode select switch 5c. This flow is part of the panel switch status change process executed in step G8 of the general flow of FIG. 5.

First, it is discriminated in step W1 whether or not string release mode select switch 5c is depressed. If the decision is negative, the flow advances to step W2 for executing other processes If the decision is affirmative, it is discriminated in step W3 whether the string release sound stop mode is ON or OFF. If the mode is ON, flag OFFFG is set to 1 in step W4, and if it is OFF, the flag OFFFG is set to 0. When flag OFFFG is set to 1, the presently-generated musical is rapidly released (step V8 in FIG. 21). On the other hand, when flag OFFFG is set to 0, the pitch of the presently-generated musical tone is changed to that of the open string (step V9 in FIG. 21).

[Review of Open String Sound Stop And Frequency Change Functions]

With the above explanation, it should be understood that the second feature or the frequency change function (see FIGS. 7a–7c) for changing the frequency of a musical tone without generating a new musical tone and the fifth feature or the string-based sound stop function (see FIG. 10) resulting from a change to the open-string operated status are both realized by this embodiment.

To begin with, the frequency change function as the second feature of this embodiment will be described In the sound source assigning/sound generating process (see FIGS. 14 and 17), microcomputer 30 assigns a sound source module to generates a musical tone with a predetermined pitch and writes sound source control data into sound source control registers a, b and c (FIG. 16). The control data includes data as to which string's musical tone the sound source module is generating and data as to at what pitch the musical tone is generated. When the fret operation status is moved to a different fret position of the string during generation of the musical tone of the specific string, microcomputer 30 detects the change (as to on which fret position of which string the fret operation status is changed) through the process shown in FIG. 20, and searches for the sound source module that is generating the musical tone of the string and causes the found sound source module to undergo the frequency change process for changing only the frequency of the presently-generated musical tone through the process as shown in FIG. 21. Therefore, the function described with reference to FIGS. 7a–7c is certainly realized.

The frequency change function of this embodiment is performed in response to a change in the fret operation position of the same string as is presently-generating a musical tone. In other words, this function is executed when fingering is applied to a single string. For instance, performance similar to the sliding performed with an acoustic guitar, etc. or the fingering for a quick phrase with respect to the same string (in either case, the picking being done only once at the beginning) may be utilized to provide the same musical effect as can be attained by the mentioned sliding or fingering.

With regard to the fifth feature of this embodiment or the open string sound stop function due to a change to the open-string operated status, microcomputer 30 causes pitch designation register C-RG and string number designation register B-RG to memorize that the fret position of the presently-generated musical tone is changed to the open-string operated status, through the process as shown in FIG. 20. Through the process as shown in FIG. 21, microcomputer 30 then finds the sound source module that is presently generating a musical tone and confirms that the fret status is changed to the open-string operated status by checking the value of register C-RG In this case, the found sound source module is subjected to the sound stop process as long as flag OFFFG is set.

From the above, it is obvious that the string-based sound stop function due to the transition to the open-string operated status as described with reference to FIG. 10*a*–10*c* is indeed realized. The string-based sound stop function of this embodiment is particularly advantageous under the circumstance where the condition for the note off cannot easily be attained by switches such as string triggering switches TSW (FIG. 3). A performer can freely control the sounding time of the musical tone of a triggered string by moving his or her fingers off the string at a desired timing. In addition, this sound stop function is suitable for playing a melody, sequentially using a plurality of strings. It is further advantageous that no extra switches are needed for the note off process.

Further, according to this embodiment, the switching function is provided which can give higher priority to the frequency change function suitable for the sliding than the open string sound stop function. Specifically, string release mode select switch 5*c* is provided in the instrument's main body to provide easier performing facility to a performer.

Figure 23:
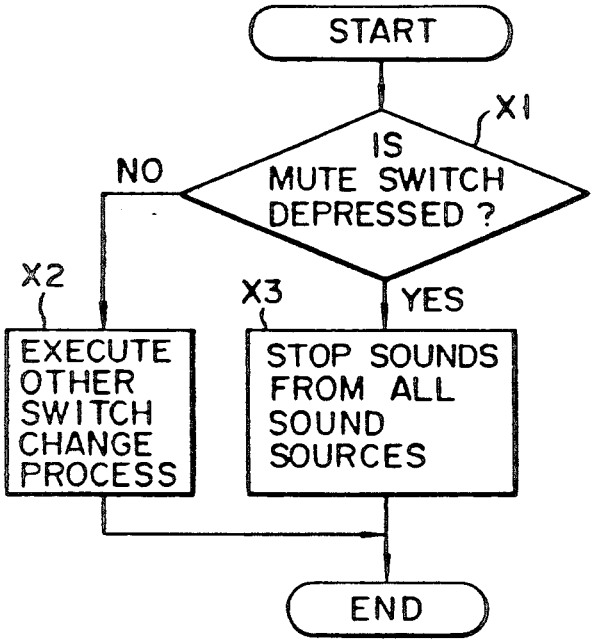
FIG. 23 is a flowchart with respect to a mute switch input.
Figure 24:
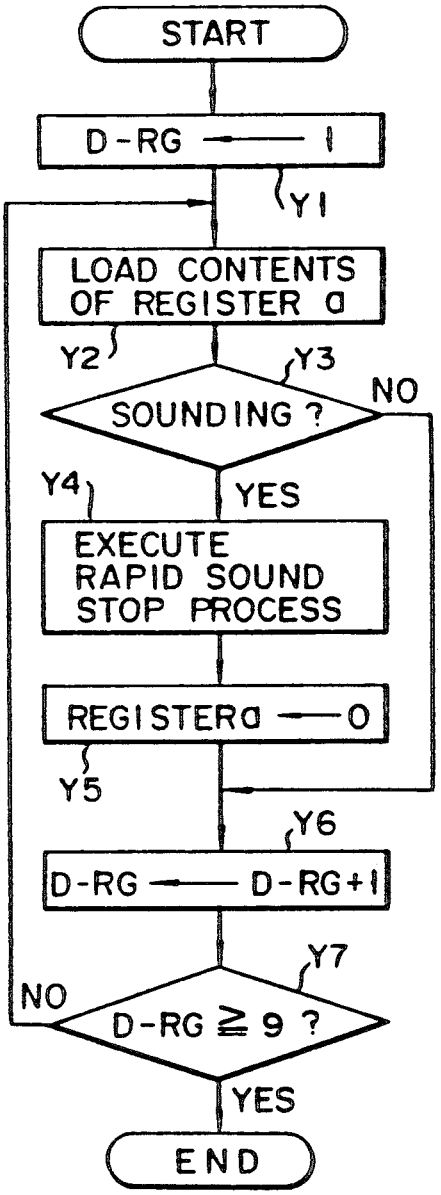
FIG. 24 is a detailed flowchart of a full sound source stop process shown in FIG. 23.

Mute Switch Process (FIGS. 22 to 24)

The following explains the mute switch process (FIG. 23) which is performed by microcomputer 30 (FIG. 4) as part of the panel switch status change process (step G8) of the general flow (FIG. 5).

When mute switch 5*b* (FIG. 1) provided in the instrument's main body is depressed, the mute function, which is the eighth feature of this embodiment, requests all the sound source modules that are generating musical tones at that time to simultaneously and rapidly stop the tone generation.

More specifically, in the first step X1 of the flow shown in FIG. 23, microcomputer discriminates whether or not mute switch 5*b* is depressed. If the decision is negative, other panel switch status change processes indicated by step X2 are executed; if it is affirmative, the entire sound source stop sound process is performed in step X3.

This sound stop process is illustrated in detail in FIG. 24. A value "1" is set in sound source number register D-RG to initialize the sound source module number in the first step Y1, and thereafter, the loop of Y2–Y7 is performed with respect to the sound source module indicated by the value of register D-RG.

In the first step Y2 of the loop, of the contents of the registers (sound source control registers shown in FIG. 16) for controlling the sound source module specified by the value of register D-RG, the value (string number) of string number designation register a is loaded. As described earlier, when the value of register a is zero, it indicates that the associated sound source module is not presently used or is not presently generating a musical tone, and when the value is other than zero, the musical tone associated with the loaded value is being generated from the associated sound source module. In the subsequent step Y3, it is discriminated whether or not the presently-designated sound source module is generating a musical tone. If the tone is being generated, the rapid sound stop process is performed with respect to the sound source module (specified by the value of register D-RG) in step Y4, and zero is written in string number designation register a of the sound source module in the next step Y5, thereby memorizing that this sound source module is unused. After step Y5 or when it is discriminated in step Y3 that the presently-designated sound source module is not generating a musical tone, the value of register D-RG is incremented by one in step Y6 to search the next sound source module other than the presently-designated module. In the subsequent step Y7, it is discriminated whether the value of register D-RG is less than or equal to 8 so as to determined the completion of the rapid sound stop process with respect to all of the eight sound source modules included in musical tone generating circuit 60 (FIG. 4). If the value of register D-RG is less than or equal to 8, it means that there still remain unchecked sound source modules, so that the loop starting from step Y2 is repeated. If this value becomes 9, it means that all the sound source modules have been checked and the rapid sound stop process is completed.

With the above explanation, it should be clear that the mute function described with reference to FIG. 11*a*–11*c* is realized. Unlike the ordinary OFF process, the rapid sound stop process rapidly releases a musical tone.

This mute function ensures the cutting performed with an acoustic guitar, etc.

According to this embodiment, in response to the operation of a single mute switch 5*b*, all of the presently-generated musical tones are rapidly released; however, other modifications may be possible. For instance, a plurality of mute switches may be provided, and the rapid sound stop process need not be performed with respect to all of the strings presently generating musical tones but it may be performed separately with respect to the musical tone or tones associated with a single selected string or a plurality of selected strings (to be accurate, those sound sources which are generating the musical tones of these strings).

The entire string sound stop function as the sixth feature and the mute reserve function as the ninth feature will now be explained referring to FIGS. 25 to 28.

Figure 25:
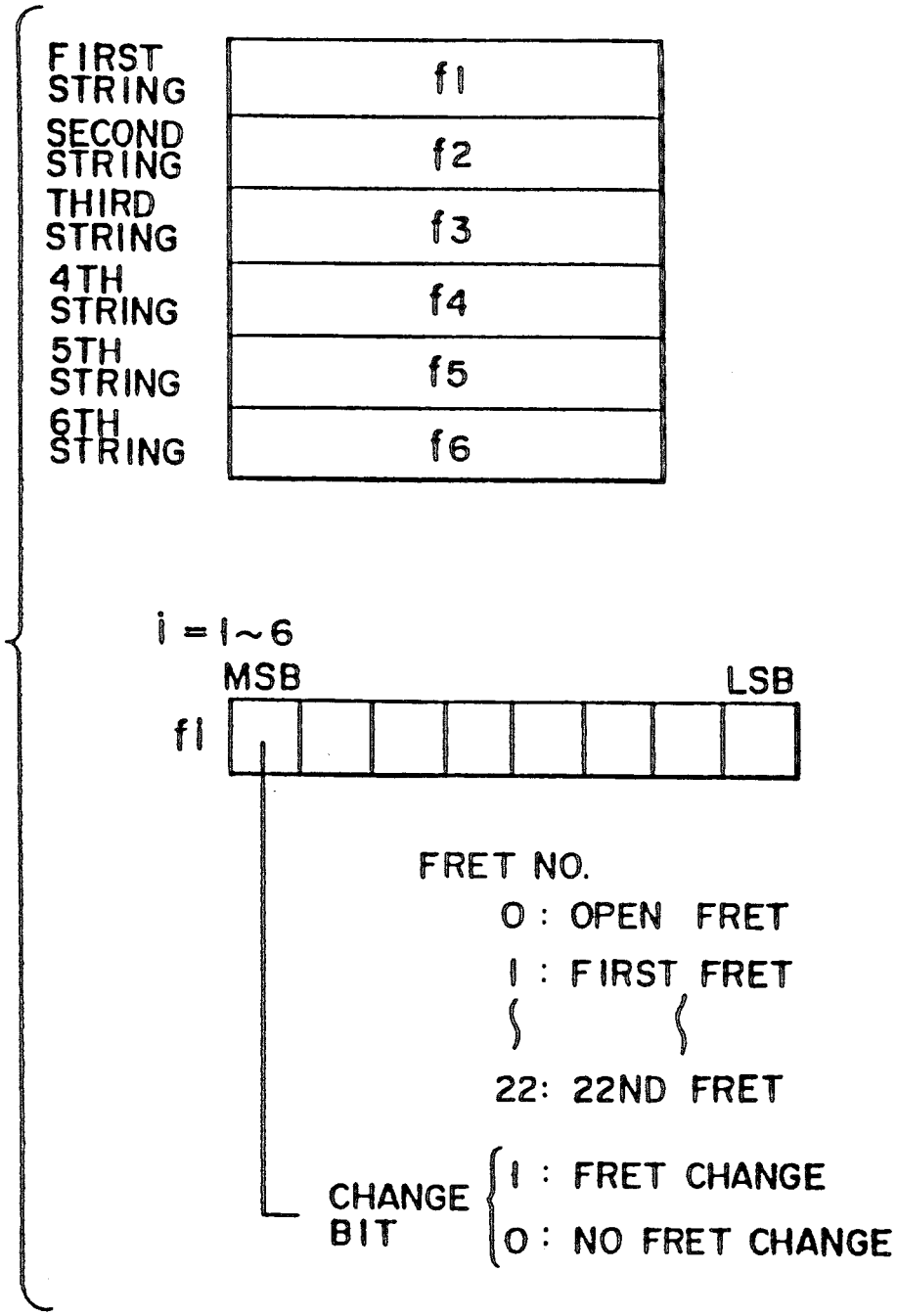
FIG. 25 is a diagram illustrating registers associated with frets.

Six registers $f_1$ to $f_6$ shown in FIG. 25 are used for fret-oriented processes and are respectively provided for first to sixth strings. Each register $f_i$ has an 8-bit structure, and F7 bit indicates the fret position data (fret number) of the associated string. All the F7 bits being "0" indicates the open string status. The most significant bit (MSB) indicates whether or not the fret status is changed, and the MSB being logical "1" indicates the occurrence of the change.

Microcomputer 30 sets these registers $f_1$ to $f_6$ in step G3 of the general flow (FIG. 4) and checks the MSB of each register $f_i$ in step G4. If any MSB is logical "1," which means that there is a fret status change, the flow advances to step G5 to perform the fret status change process.

Through this fret status change process, microcomputer 30 realizes various functions including the aforementioned full string sound stop function and the string-based sound stop function.

Figure 26:
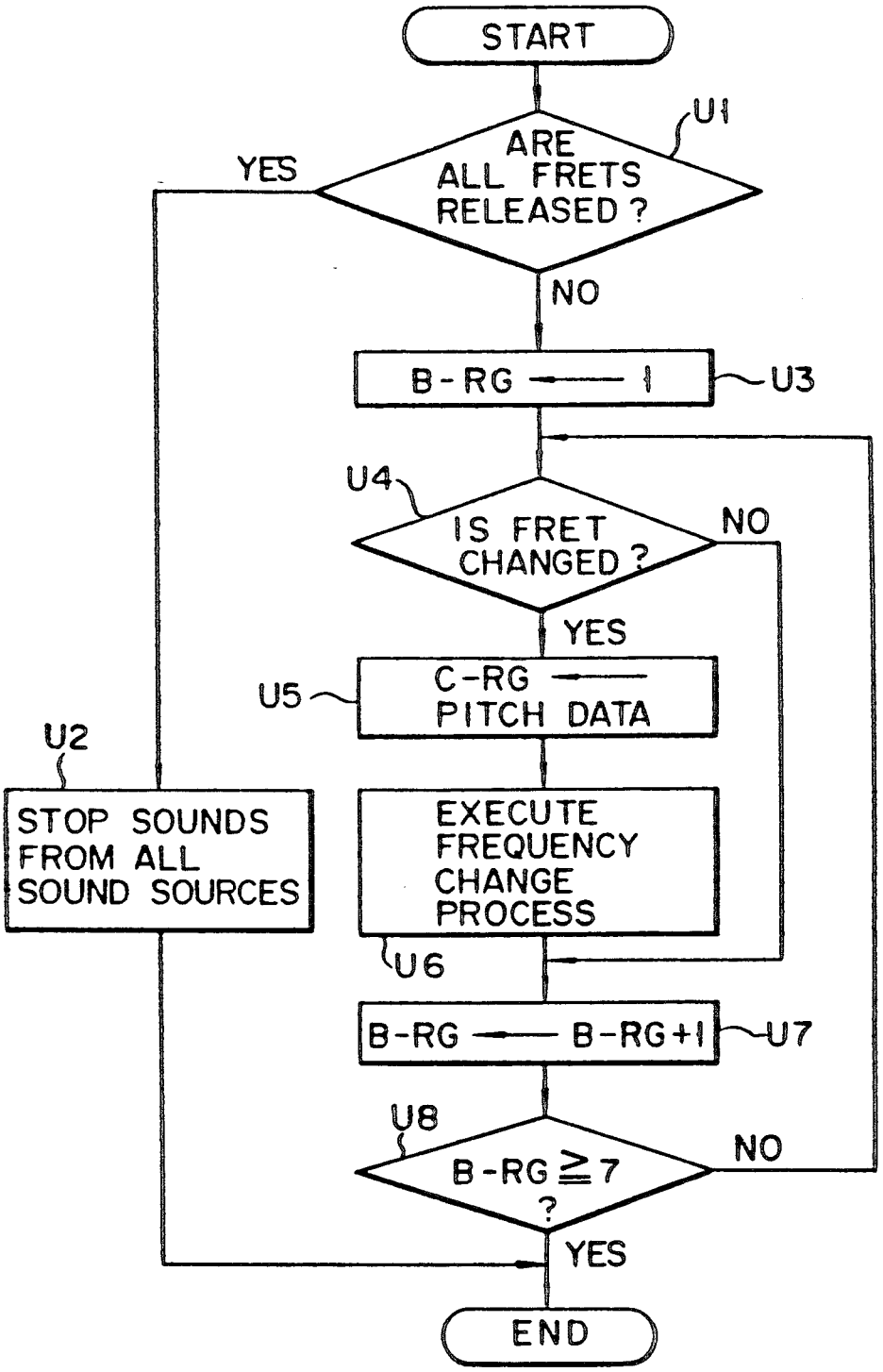
FIG. 26 is a flowchart of a fret status change process.

FIG. 26 is a detailed illustration of the frets status change process.

In the first step U1, microcomputer 30 refers to the F7 bits of registers f1–f6 to discriminate if all the frets are open. When the F7 bits of registers f1–f6 are all zeros, the fret status is the full open-string operated status. Systematically, the decision in step U1 indicates the full open-string operated status when any one or more of the first to sixth strings is depressed and the string-depressing fingers are then released off all the depressed strings. At this time, some strings (to be accurate, internal sound sources assigned to these strings)

may be or may not be generating musical tones. It is possible to check which string is generating its musical tone through the same procedures as described in the sound source assigning/sound generating process. In brief, string number designation register a which indicates the status of each sound source module exemplified in FIG. 16 should only be referred to, and if its value is not zero, the associated string is "generating a musical tone." The full tone stop process executed in step U2 in the case of the full open-string operated status is basically preformed in the same manner as has just been explained. All the sound source modules which are "generating musical tones" are given with a sound stop request, and their associated, string number designation registers a are all reset to be zeros to indicate that all sound source modules are unused. (The sound stop request may be sent to all the sound source modules without referring to registers a. Those modules which are not generating musical tones simply become NOP.) Anyway, in response to the full-source sound stop request, every tone-generating sound sources enters the release mode and releases the generated musical tone. As a result, the simultaneous tone off can be sensed.

When any fret is depressed, a value of "1" is written in string number designation register B-RG in step U3 and the loop of steps U4-U8 is thereafter repeated.

In the first step U4 of the loop, it is discriminated whether or not a fret change exists. This discrimination can be done by loading the content of that register $f_{B-RG}$ which is indicated by the value of register B-RG and checking its MSB. If the change exists, the fret number data located in the lower 7 bits of the register $f_{B-RG}$ is written in pitch designation register C-RG in step U5. In the subsequent step U6, a frequency change process (FIG. 27; its detailed description will be given later) using both of the values of the aforementioned string number designation register B-RG and pitch designation register C-RG. If no fret change is discriminated in step U4, or after the frequency change process performed in step U6, the value of string number designation register B-RG is incremented by one to increase the string number by one in step U7. In the subsequent step U8, it is discriminated whether the value of register B-RG is less than or equal to 6, and while the value is less than or equal to 6, the loop starting from step U4 is repeated.

When the process for the fret change with respect to all the strings is completed, the value of register B-RG is determined to be 7 in step U7, thus leaving the flow of the fret status change process.

Figure 27:
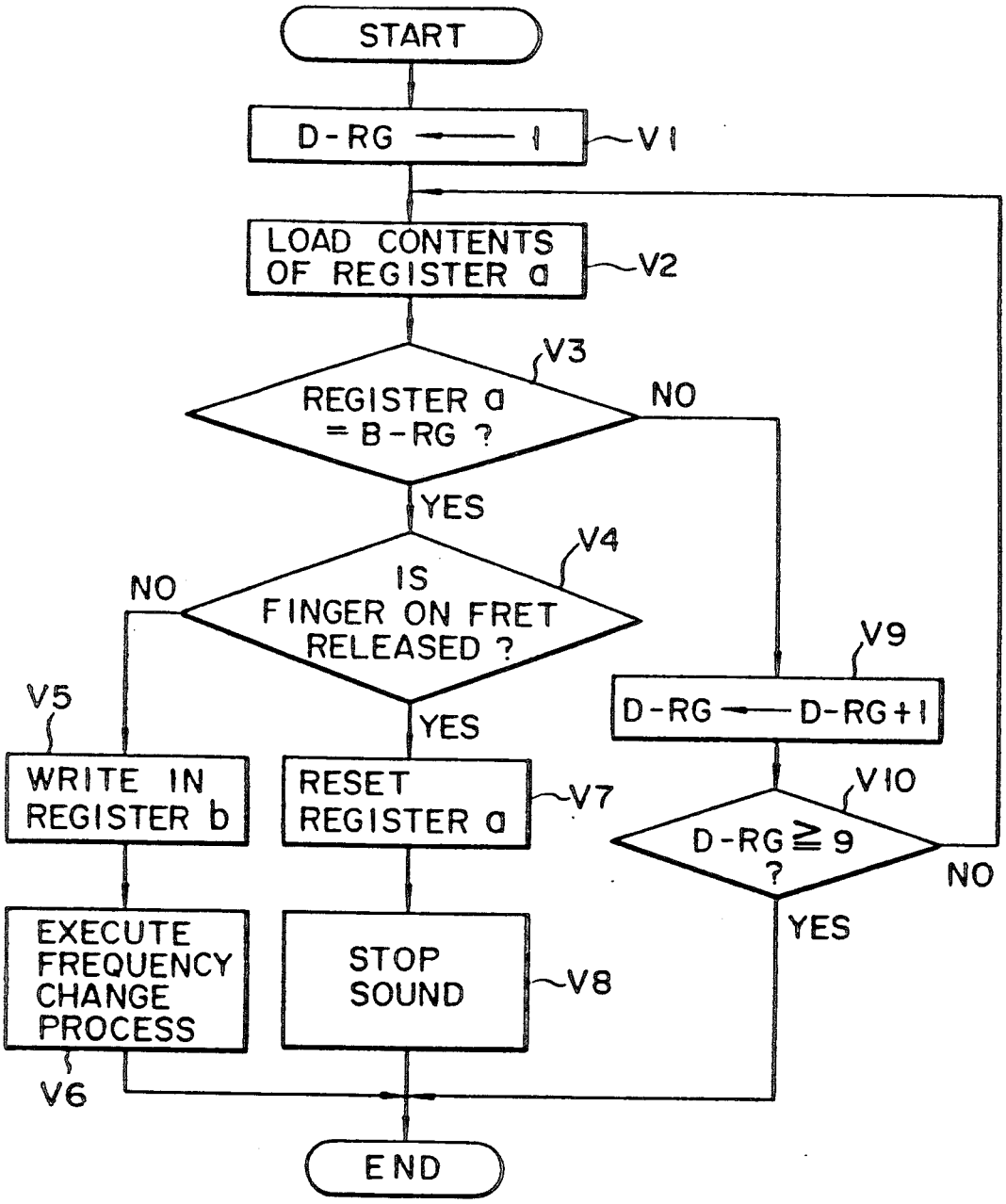
FIG. 27 is a flowchart of a frequency change process.

FIG. 27 is a detailed flowchart of the aforementioned frequency change process. At the time the flow starts, the position data of a changed fret is held in pitch designation register C-RG and a value (string number) indicating on which string the fret change occurred is held in string number designation register B-RG.

In step V1, the content of sound source number designation register D-RG is initialized to be 1. Then, the value (string number) of string number designation register a of the sound source module control register (FIG. 16) indicated by the value of register D-RG is loaded in step V2, and it is then discriminated in step V3 whether or not the loaded value of register a equals the value of string number designation register B-RG. That is, it is checked in step V3 whether or not the musical tone associated with the string whose fret position has changed is being generated. If the decision in this step is a non-coincidence, the flow advances to step V9 where the value of sound source number register D-RG is incremented by one to increase the number of the sound source module to be checked by one, and then advances to step V10 where it is discriminated whether or not the value of sound source number designation register D-RG is less than or equal to 8. If the value is less than or equal to 8, the flow returns to step V2 to thereby repeat the loop; if the value equals 9, the process is completed.

The value of register D-RG becomes 9 in step V10, thus completing the process, when a fret change occurs on the fret of the string associated with that musical tone which is undergoing the sound stop process. In such a fret change operation, the fret change is considered to be invalid so that no musical tone processing is performed.

When a fret change occurs with respect to the string associated with the presently-generated musical tone, there exists the sound source module which is generating the musical tone and this is stored in string number designation register a of the associated sound source module control register. Therefore, when the value of register D-RG indicates a sound source module number, the value of register a = the value of string number designation register B-RG is satisfied in step V3.

If it is discriminated in step V3 that the musical tone associated with the string whose fret position has changed is presently being generated, the flow advances to step V4 where it is discriminated whether or not the fret status is changed to the open-string operated status by checking the value of pitch designation register C-RG (fret status register). If the fret status is not changed to the open-string operated status (i.e., a different fret being depressed), the flow advances to step V5 where frequency (pitch) data is calculated from the fret number data of the F7 bit of register C-RG, which indicates the fret position, and the string number data, which is the value of register B-RG and the frequency data is written in register b. In step 6, the frequency change process is executed so that the frequency of the musical tone from the sound source module corresponding to the value of register D-RG is changed on the basis of the frequency data written in register b. Consequently, only the frequency of the musical tone is changed without generating a new musical tone.

If it is discriminated in step V4 that the fret status is changed to the open = string operated status (i.e., when the F7 bits of pitch designation registers C-RG are all zeros), the flow advances to step V7 where register a is reset to zero. In the subsequent step V8, the sound source module associated with the value of register D-RG stops the tone generation. This sound stop is executed string by string. That is, provided that the musical tone of that string is being generated, or provided that the sound source for generating the musical tone of the string is assigned by the sound source assigning/sound generating process and starts the tone generation, this sound stop request is made to the sound source (which dynamically corresponds to each string) when the fret status of a specific string is changed to the open-string operated status. In this manner, the musical tone is stopped for each string.

Figure 28:
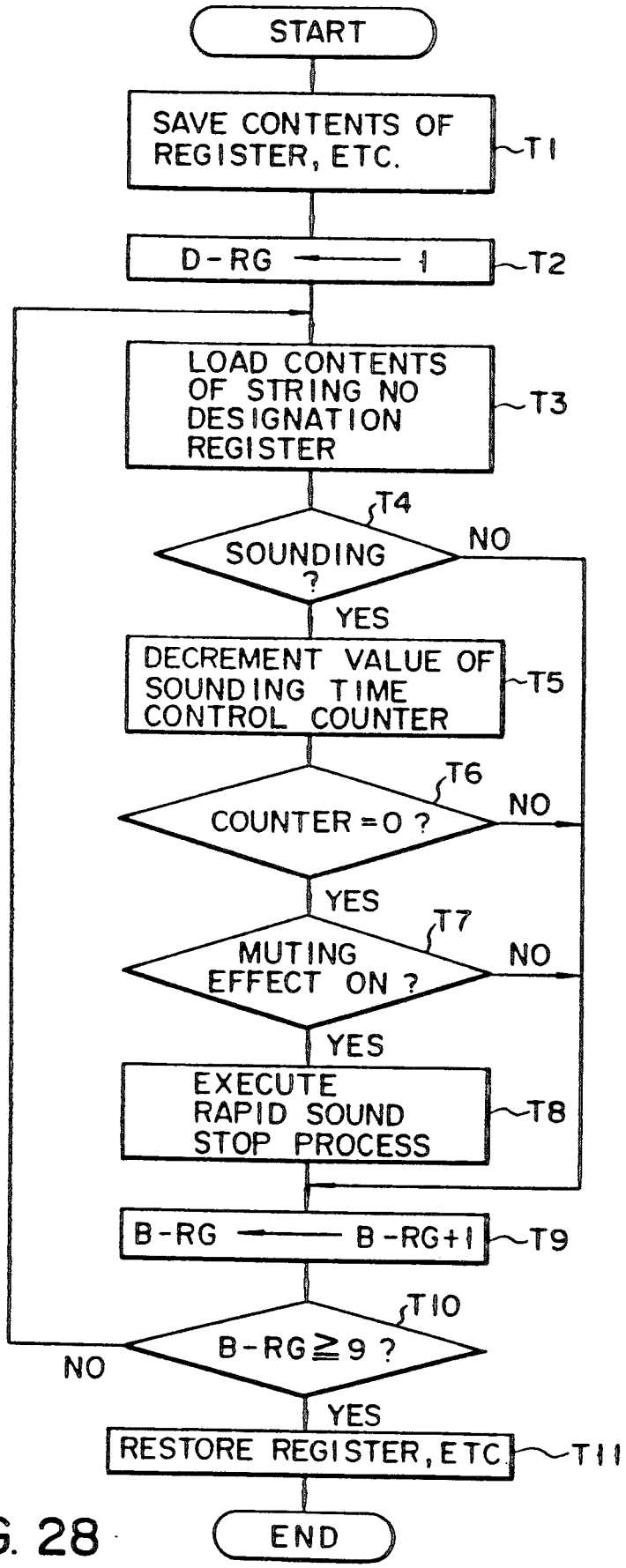
FIG. 28 is a flowchart of a muting process.

Mute Reserve Function (FIG. 28)

As described earlier, mute reserve switch MSW is provided on the body of the electronic stringed instrument of this embodiment. A performer can operate this mute reserve switch MSW any time during performance to reserve the muting. A change in mute reserve switch MSW is detected in step G7 of the general flow (FIG. 4) and a mute flag is set in step G8 to a value indicating the "muting effect ON."

Further, as described above, when string triggering occurs, it is detected by microcomputer 30 (FIG. 4), and through the flow of sound source assigning/sound generating process shown in FIG. 17, an unused sound source module is found from all the sound source modules of musical tone generating circuit 60 (FIG. 4) in order to generate the musical tone associated with the triggered string and this module is subjected to the ON process in step R16. And, the sounding time data is written in sounding time control counter c (FIG. 16) of the control register of that module in step R16.

Microcomputer 30 performs a decrement operation on the sounding time data set in counter c for each execution of the interrupt routine (the flow of the muting process as shown in FIG. 28), which puts an interrupt for each determined time interval. And, when the underflow of sounding time control counter c occurs, microcomputer 30 causes the associated sound source module to stop the tone generation.

The mute reserve function will be explained below along with the flowchart of FIG. 28. First, data saving in a register, etc. is executed in step T1 as per an ordinary interrupt routine. The value of sound source number designation register D-RG, which indicates the number of the sound source module, is initialized to be 1 in step T2, and thereafter the loop T3 to T9 is executed.

In the first step T3 of the loop, the content of string number designation register a of the sound source module to be checked is loaded (when a=0, the sound source module is presently unused, and when a=0, the a-th string is generating a musical tone). In the subsequent step T4, it is discriminated whether or not a=0, i.e., whether or not the sound source module is presently generating a musical tone. If the musical tone is being generated, sounding time control counter c for controlling the sound source module is down-counted in step T5. If a borrow from this counter is detected in step T6, the flow advances to step T7 where it is determined whether or not the muting effect is rendered ON, i.e., whether or not the muting is reserved by operation of mute reserve switch MSW. If the muting is reserved, the flow advances to step T8 where the sound source module is subjected to the rapid sound stop process and the content of string number designation register a is set to zero to memorize that the sound source module is no longer generating a musical tone. After step T8 or when the decisions in steps T4, T6 and T7 are negative, the flow advances to step T9 where the value of sound source number designation register D-RG is incremented by one. Then, in the subsequent step T10, it is discriminated whether or not the value of register D-RG is less than or equal to 8, and if the value is less than or equal to 8, the flow returns to step T3 to thereby repeat the loop.

After the loop is completed, data is restored in registers, etc. (step T11), as is the case where the interrupt process is completed.

When the muting is reserved, therefore, the musical tone generated by picking string 4 is rapidly released upon elapse of the time measured by the sounding time counter after the beginning of the tone generation. This can provide the same acoustic effect as the muting effect attained by an acoustic guitar, etc.

[Modification]

This invention is not limited to the above particular embodiment, but may be modified or improved in various manners.

Figure 29:
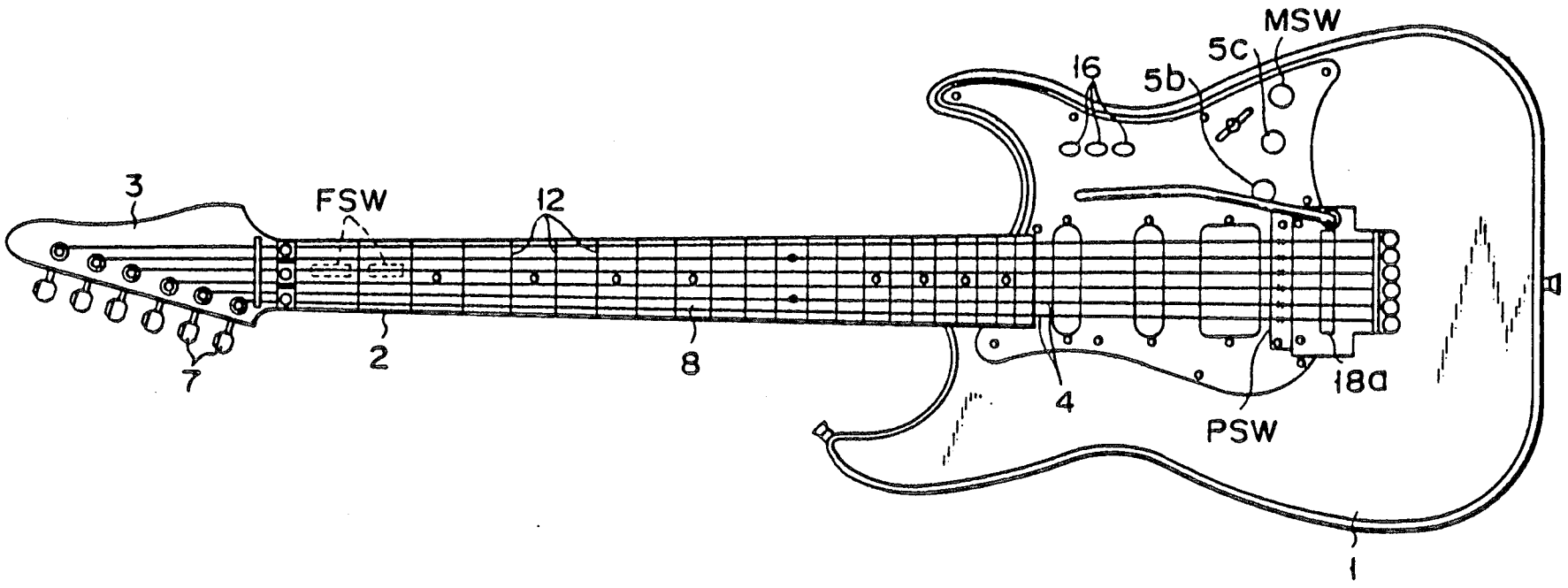
FIG. 29 is a plan view of an electronic stringed instrument according to another embodiment of this invention.

According to the above-described embodiment, this invention is applied to a string triggering type of electronic stringed instrument, which has a number of fret switches FSW provided on fingerboard 8 and has string triggering switches TSW coupled to the respective strings 4 stretched on body 1. However, application of this invention is not limited to the above instrument. For instance, this invention is applicable to an electronic stringed instrument, which has a number of fret switches FSW provided on fingerboard 8 and has electromagnetic type pickups PSW provided below the respective strings 4, stretched on body 1, so as to detect the string vibration, as shown in FIG. 29. This invention can also be applied to the various types of electronic stringed instruments as explained in the first section of this specification, "Background of the Invention."

Further, according to this embodiment, the full string sound stop function causes all the sound sources generating musical tones to stop the tone generation immediately, simultaneously and in the same manner, in response to the transition to the full open-string status. Here, the term "in the same manner" means that the musical tones are released at the same sound stopping time (release time).

The musical tones may be released at different release times, not in the same manner. For instance, in order to provide different release times for the individual strings, the musical tone of a lower-tone string is released with a longer time than that of a higher-tone string. This may be realized by selectably switching the release portion of the envelope in accordance with a variable such as the string number specified by the value of register B-RG.

The musical tones may be released at different timing, not simultaneously.

The musical tones may be released with a delay, not immediately. To be specific, upon occurrence of a full open-string event, all of the tone-generating strings are subjected to the sound stop process with some delay. In addition, the delay may be set to be programmable by a user. Measuring the delay may be realized by counter means or timer means. If the tone generation is stopped immediately, a performer will have natural and realistic operational feeling and can easily play staccato.

Furthermore, the full string sound stop function may be designed inapplicable to a specific string. For instance, in application utilizing a certain string as a pedal line, the full string sound stop function is not applicable to the string serving as the pedal line. Even in this case, the meaning of the full string sound stop is not lost. The full string sound stop function should affect all of a plurality of strings (not necessarily all the strings used in an electronic stringed instrument), and is activated when all of these strings are set in the so-called open-string status as the necessary condition, thereby causing all of tone-generating strings (or sound sources) to stop the tone generation.

What is claimed is:

1. An electronic stringed instrument, comprising:

an instrument body having a fingerboard on which fingering operation is performed;

at least one string stretched on the instrument body;

string vibration detecting means for detecting vibration of the string;

position detecting means for detecting a position of the fingering operation performed on said fingerboard;

open-string operation detecting means for detecting an operation of an open string in which the fingering operation is not performed on said fingerboard;

instruction means for responding to the vibration of said string detected by said string vibration detecting means, and for instructing to generate a musical tone having a pitch of the open string corresponding to the operation of said open string, in the condition that the operation of said open string is detected by the open-string operation detecting means, and on the other hand, for responding to the vibration of said string detected by said string vibration detecting means, and for instructing to generate a musical tone having a pitch corresponding to said position of the fingering operation, in the condition that said position of the fingering operation is detected by said position detecting means;

judge means for judging whether the position of said fingering operation detected by said position detecting means is shifted to the other position of the fingering operation except for said position of the fingering operation, or to said open-string operation condition; and control means for responding to the judgment by said judge means that the position of the fingering operation is shifted to said open string operation condition, during generating the musical tone having the pitch corresponding to the position of the fingering operation detected by said position detecting means, according to the instruction of said instruction means, and for controlling to stop the generated tone, and on the other hand, for responding to the judgment by said judge means that said position of the fingering operation is shifted to said position of the other fingering operation, and for controlling to alter the pitch of the musical tone corresponding to said position of the fingering operation to a pitch corresponding to said other position of the fingering operation, in the condition that the musical tone is being generated.

2. The electronic stringed instrument according to claim 1, further comprising musical tone generating means for generating the musical tone in accordance with instructions supplied from said instruction means.

3. The electronic stringed instrument according to claim 2, wherein said musical tone generating means is provided in said instrument body.

4. An electronic stringed instrument, comprising:

an instrument body having a fingerboard on which fingering operation is performed;

at least one string stretched on said fingerboard;

string vibration detecting means for detecting vibration of the string;

position detecting means for detecting a position of the fingering operation performed on said string;

open-string operation detecting means for detecting an operation of an open string in which the fingering operation is not performed on said string;

instruction means for responding to the vibration of said string detected by said string vibration detecting means, and for instructing to generate a musical tone having a pitch of the open string corresponding to the operation of said open string, in the condition that the operation of said open string is detected by the open-string operation detecting means, and on the other hand, for responding to the vibration of said open string detected by said string vibration detecting means, and for instructing to generate a musical tone having a pitch corresponding to said position of the fingering operation, in the condition that said position of the fingering operation is detected by said position detecting means;

judge means for judging whether said position of the fingering operation detected by said position detecting means is shifted to the other position of the fingering operation except for said position of the fingering operation, or to said open-string operation condition; and control means for responding to the judgment by said judge means that said position of the fingering operation is shifted to said open string operation condition, during generating the musical tone having the pitch corresponding to the position of the fingering operation detected by said position detecting means, according to the instruction of said instruction means, and for controlling to stop the generated tone, and on the other hand, for responding to the judgment by said judge means that said position of the fingering operation is shifted to said other position of the fingering operation, and for controlling to alter the pitch of the musical tone corresponding to said position of the fingering operation to a pitch corresponding to said other position of the fingering operation, in the condition that the musical tone is being generated.

5. The electronic stringed instrument according to claim 4, further comprising musical tone generating means for generating the musical tone in accordance with instructions supplied from said instruction means.

6. The electronic stringed instrument according to claim 5, wherein said musical tone generating means is provided in said instrument body.

* * * * *